US008215738B2

(12) United States Patent
Sumi

(10) Patent No.: US 8,215,738 B2
(45) Date of Patent: Jul. 10, 2012

(54) DROPLET EJECTION APPARATUS AND IMAGE FORMING APPARATUS

(75) Inventor: Katsuto Sumi, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 361 days.

(21) Appl. No.: 12/569,834

(22) Filed: Sep. 29, 2009

(65) Prior Publication Data

US 2010/0079544 A1 Apr. 1, 2010

(30) Foreign Application Priority Data

Sep. 30, 2008 (JP) ..... 2008-255291

(51) Int. Cl.
*B41J 29/38* (2006.01)

(52) U.S. Cl. ..... 347/12; 347/11

(58) Field of Classification Search ..... 347/12, 347/15, 9–10, 49
See application file for complete search history.

(56) References Cited

U.S. PATENT DOCUMENTS

| | | | |
|---|---|---|---|
| 6,019,453 | A | 2/2000 | Tsuruoka |
| 2005/0024428 | A1 | 2/2005 | Matsuo et al. |
| 2007/0126797 | A1 | 6/2007 | Hibbard et al. |
| 2007/0139455 | A1 | 6/2007 | Iriguchi |

FOREIGN PATENT DOCUMENTS

| | | | |
|---|---|---|---|
| EP | 2 065 199 | A | 6/2009 |
| JP | 6-198893 | A | 7/1994 |
| JP | 9-104113 | A | 4/1997 |
| JP | 2007-144751 | A | 6/2007 |

*Primary Examiner* — Lamson Nguyen
(74) *Attorney, Agent, or Firm* — Birch, Stewart, Kolasch & Birch, LLP.

(57) ABSTRACT

The droplet ejection apparatus includes a plurality of nozzles in a row connected to the same liquid supply flow channel are divided into M nozzle group blocks, and the ejection timings are shifted for blocks so that the number of nozzles ejecting simultaneously within the same nozzle row can be reduced and the effect of crosstalk can be reduced, whereby reduction of power source capacity in a drive circuit system can be achieved. Furthermore, shifting of the deposition position caused by the difference in the ejection timing is resolved by the nozzle arrangement, whereby good recording can be performed without shifting dot positions.

7 Claims, 21 Drawing Sheets

DROPLET EJECTION APPARATUS AND IMAGE FORMING APPARATUS

BACKGROUND OF THE INVENTION

1. Field of the Invention

The present invention relates to a droplet ejection apparatus and an image forming apparatus, and particularly to a head structure for reducing the crosstalk caused by a flow channel structure of a droplet ejection head having a plurality of nozzles (droplet ejection ports) arrayed two-dimensionally, and a drive control technology of the head structure.

2. Description of the Related Art

Japanese Patent Application Publication No. 06-198893 discloses a technology of an inkjet printer having a one-dimensionally arranged nozzle row in which the ejection timings are shifted between adjacent nozzles to prevent resonant oscillation of liquid between the nozzles in order to increase the drive frequency so that the productivity is improved. More specifically, the nozzles in the nozzle row are divided into four nozzle groups of every fourth nozzles. The nozzles in the same nozzle group are caused to simultaneously eject the ink, whereas the phases of the respective nozzle groups are shifted with each other. In this inkjet printer, the positions of orifices (nozzles) are corrected beforehand in order to reduce printing misregistration caused by shifting the ejection timings between the nozzle groups.

Japanese Patent Application Publication No. 09-104113 discloses a technology in which a plurality of recording elements (nozzles) arranged one-dimensionally are divided into a plurality of blocks, and "division record" is carried out in which the recording timings are shifted between the blocks for reducing the increase in crosstalk and power source capacity, which are problems caused when driving all of the nozzles at the same time. Moreover, the shift of the recording timings is slightly changed so as to absorb an angular error generated when attaching line heads.

Japanese Patent Application Publication No. 2007-144751 discloses a technology in which a plurality of nozzles formed in an inkjet head are divided into a plurality of nozzle groups (for example, respective groups of K, C, M and Y), a plurality of images are recorded while shifting the ejection timings between the first nozzle group and the rest of the nozzle groups, and the best image is determined from among these images (that is, the best ejection timing difference), thereby limiting the effects of an ejection variation caused by the crosstalk among the nozzle groups.

A head in which nozzles ejecting droplets are two-dimensionally arrayed has special problems different from those of the one-dimensionally arrayed nozzles in which the ejection timings between adjacent nozzles cannot be shifted due to the drive wiring, for example. Japanese Patent Application Publication No. 06-198893 does not mention any countermeasures for crosstalk of the two-dimensionally arrayed nozzles, and the technology described in Japanese Patent Application Publication No. 06-198893 cannot be applied to the two-dimensionally arrayed nozzles. The recording head described in Japanese Patent Application Publication No. 09-104113 has a plurality of recording elements arranged in a single row, and causes shifting in the timings for the respective blocks with respect to the inclination of the entire head. Therefore, the "vertical line" formed by the entire line head is averagely straight, but jagged lines are generated in the vertical rule, as shown in FIG. 10(*c*) and described in the paragraph 0040 in Japanese Patent Application Publication No. 09-104113, which causes a problem in the image quality. In the technology described in Japanese Patent Application Publication No. 2007-144751, shifting of the ejection timings changes the droplet deposition positions and thereby causes, for example, positional difference (color difference) between the colors, but such a problem is not mentioned.

SUMMARY OF THE INVENTION

The present invention has been contrived in view of such circumstances, and an object thereof is to provide a droplet ejection apparatus and image forming apparatus that are capable of reducing the crosstalk, such as the fluctuation (decrease) or variation in the droplet amount and droplet speed, and reducing the increase in the power source capacity, which affect a head having a plurality of two-dimensionally arrayed nozzles by turning other nozzles ON (ejecting ink from these nozzles) in a nozzle row sharing a liquid supply flow channel. The present invention also provides a droplet ejection apparatus and image forming apparatus capable of solving the problem of shifting in a deposition position.

In order to attain the aforementioned object, the present invention is directed to a droplet ejection apparatus, comprising: a droplet ejection head which has a plurality of nozzles arrayed two-dimensionally, droplets of liquid being ejected from the nozzles and deposited onto an image-rendering medium to form dots on the image-rendering medium; and a relative movement device which moves the droplet ejection head and the image-rendering medium relatively to each other in a relative movement direction, wherein: the droplet ejection head has a nozzle arrangement in which, out of the plurality of nozzles, a row of nozzles sharing a same liquid supply flow channel is divided into M (where M is an integer greater than one) nozzle group blocks and positions of all of the nozzles within each nozzle group block are shifted in the relative movement direction so as to provide a predetermined positional difference in the relative movement direction to the positions of the nozzles between the M nozzle group blocks, and the nozzle arrangement in which the nozzles are arrayed two-dimensionally is configured such that, between dots formed on the image-rendering to medium by adjacent nozzles within a certain one nozzle row, at least one dot formed by a nozzle within another nozzle row is arranged so that the dots formed by the adjacent nozzles within the one nozzle row are arranged with an interval of N (where N is an integer greater than one) dots; the droplet ejection apparatus comprises M ejection drive devices which independently perform ejection control on the respective M nozzle group blocks; and the ejection drive devices carry out ejection drive on the nozzles within the same nozzle group block at ejection timing of a same phase, and also carry out ejection drive on the nozzles in different nozzle group blocks at different ejection timings with a phase difference corresponding to the positional difference.

According to the present invention, the nozzles in the row connected to the same liquid supply flow channel are divided into the M nozzle group blocks, and the ejection timings are shifted for the blocks so that the number of nozzles ejecting simultaneously within the same nozzle row can be reduced and the effect of the crosstalk can be reduced, whereby reduction of the power source capacity in a drive circuit system can be achieved. Furthermore, according to the present invention, shifting of the deposition position caused by the difference in the ejection timing is resolved by the nozzle arrangement (shifting of the nozzle positions between the blocks), whereby good recording can be performed without shifting dot positions.

According to the present invention, the effect of the crosstalk can be reduced more effectively by carrying out N-multiple rendering for mixing the dots of N nozzle rows in the two-dimensional nozzle array, to render one dot line.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

Configuration of Head Module

Figure 1:
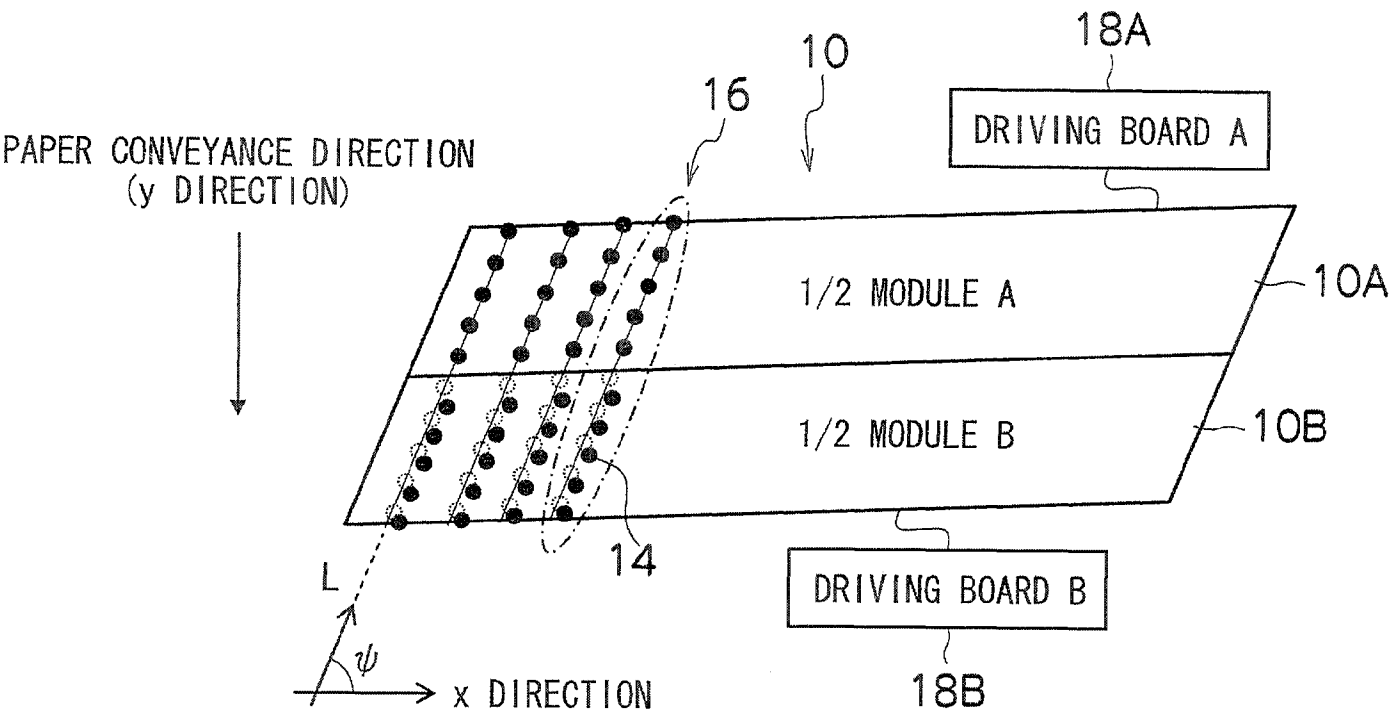
FIG. 1 is a schematic configuration diagram of a head module configuring an inkjet head according to an embodiment of the present invention.
Figure 2:
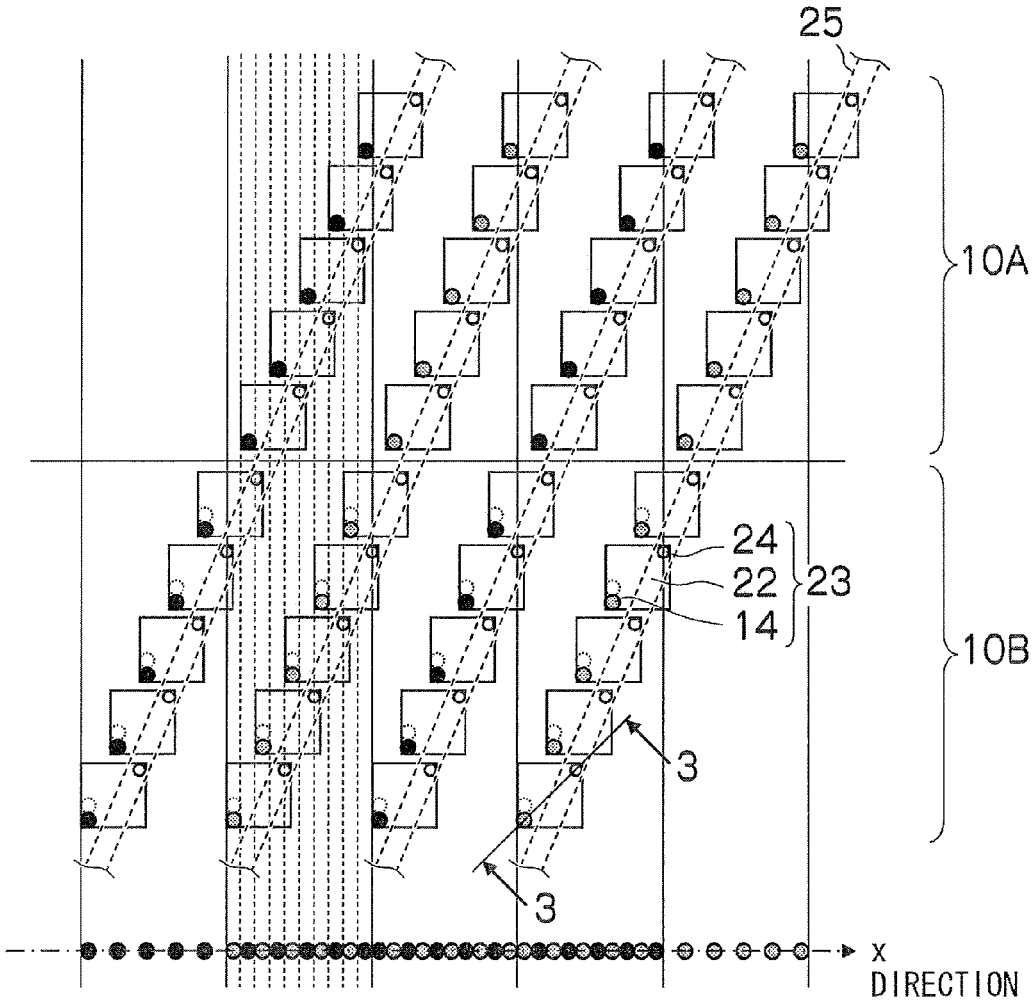
FIG. 2 is an explanatory diagram for illustrating the relationship between an internal flow channel structure and a droplet deposition position (dot position) from each nozzle within a head module.

FIG. 1 is a schematic configuration diagram of a head module 10 constituting an inkjet head according to an embodiment of the present invention. FIG. 2 is an explanatory diagram for illustrating the relationship between an internal flow channel structure and droplet deposition points (dot positions) from nozzles within the head module.

In FIG. 1, a paper conveyance direction shown by a downward arrow is a y direction, and a paper widthwise direction (lateral direction) perpendicular to the y direction is an x direction. The head module 10 has a two-dimensional nozzle array in which a plurality of nozzle rows 16 each having a plurality of nozzles 14 are arranged along the x direction with a predetermined interval therebetween. The nozzles 14 are arranged in an inclined direction (L direction) intersecting with the x direction at an angle ψ. Focusing on one certain nozzle row (for example, one nozzle row surrounded by an alternate dash and dot line) 16, the nozzles 14 belonging to this nozzle row 16 receive a supply of ink from a common (the same) ink supply channel (a common flow channel denoted with reference numeral 25 in FIG. 2).

As shown in FIG. 2, a pressure chamber 22 provided to each nozzle 14 has substantially a square planar shape, and has an outlet port for the nozzle 14 at one of diagonally opposite corners and an inlet port (supply port) 24 for receiving the supply of the ink at the other of the corners. The planar shape of the pressure chamber 22 is not limited to this embodiment and can be various shapes including quadrangle (rhombus, rectangle, etc.), pentagon, hexagon, other polygons, circle, and ellipse.

Each pressure chamber 22 is connected to the common flow channel 25 through the supply port 24. The common flow channel 25 is connected to an ink tank (not shown), which is a base tank that supplies the ink, and the ink supplied from the ink tank is distributed through the common flow channel 25 to the pressure chambers 22.

The common flow channel 25 is basically formed along a direction of the nozzle row 16, and the direction of the common flow channel 25 (the direction of the nozzle row 16) has the component of the paper conveyance direction (y direction) (see FIG. 1).

Figure 3:
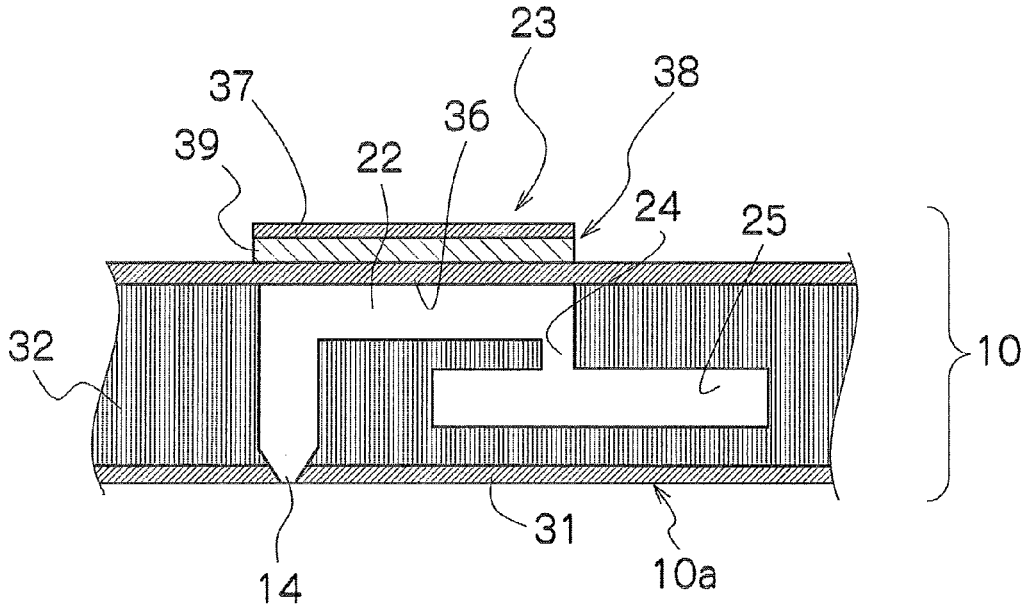
FIG. 3 is a cross-sectional diagram taken along line 3-3 in FIG. 2.

FIG. 3 is a cross-sectional diagram taken along line 3-3 in FIG. 2, showing the structure of one droplet ejection element (an ink chamber unit 23 corresponding to one nozzle 14), which is a unit of recording element.

As shown in FIG. 3, the head module 10 is configured by stacking and joining together a nozzle plate 31, a flow channel plate 32, a diaphragm 36, and the like. The nozzle plate 31 constitutes a nozzle surface (ink ejection surface) 10*a* of the head module 10 and has formed therein the nozzles 14 communicating respectively to the pressure chambers 22.

The flow channel plate 32 constitutes side wall parts of the pressure chamber 22 and serves as a flow channel formation member, which forms the supply port 24 as an aperture part (the narrowest part) of the individual supply channel leading the ink from the common flow channel 25 to the pressure chamber 22. FIG. 3 is simplified for the convenience of explanation, and the flow channel plate 32 may be structured by stacking one or more substrates.

The diaphragm 36 constituting one wall face (upper face in FIG. 3) of the pressure chamber 22 is made of an electrically-conductive material, such as stainless steel (SUS), or silicon (Si) with a nickel (Ni) conductive layer. The diaphragm 36 also serves as a common electrode of a plurality of actuators (piezoelectric elements) 38, which are disposed on the respective pressure chambers 22. The diaphragm can be formed by a non-conductive material such as resin; and in this case, a common electrode layer made of a conductive material such as metal is formed on the surface of the diaphragm member. A piezoelectric body 39 is arranged on a surface (upper side in FIG. 3) of the diaphragm 36 that is on the opposite side from the pressure chamber 22, so as to be in a position corresponding to the pressure chamber 22, and an individual electrode 37 is formed on an upper surface of the piezoelectric body 39 (surface on the other side of the surface contacting the diaphragm 36 serving as the common electrode). This individual electrode 37, the common electrode (served by the diaphragm 36 in this embodiment) opposing the individual electrode 37, and the piezoelectric body 39 interposed between these electrodes configure the piezoelectric element functioning as each actuator 38. Lead zirconate titanate, barium titanate, or other piezoelectric material is favorably used as the piezoelectric body 39.

When a drive voltage is applied between the individual electrode 37 of the actuator 38 and the common electrode, the actuator 38 is deformed, the volume of the pressure chamber 22 is thereby changed, and the pressure in the pressure chamber 22 is thereby changed, so that the ink inside the pressure chamber 22 is ejected through the nozzle 14.

When the displacement of the actuator 38 is returned to its original state after the ink is ejected, new ink is refilled in the pressure chamber 22 from the common flow channel 25 through the supply port 24.

The present embodiment applies the piezoelectric elements as ejection power generation devices to eject the ink from the nozzles 14; however, instead, a thermal system that has heaters within the pressure chambers 22 to eject the ink using the pressure resulting from film boiling by the heat of the heaters can be applied.

As shown in FIGS. 1 and 2, in the head module 10 according to the present embodiment, the nozzle row 16 sharing the common flow channel 25 is divided into M (M=2) nozzle group blocks (groups) in the paper conveyance direction. In other words, the head module 10 is structured such that the entire two-dimensional nozzle array is divided into two groups in the paper conveyance direction (y direction) and is configured by an upper ½ module 10A and a lower ½ module 10B, as shown in FIG. 1. The ½ modules 10A and 10B are provided respectively with driving boards (same as "ejection drive devices") 18A and 18B, for individually driving the nozzle groups belonging to the ½ modules 10A and 10B.

A drive circuit of the driving board 18A drives the group of the nozzles belonging to the ½ module 10A, and a drive circuit of the driving board 18B drives the group of the nozzles belonging to the ½ module 10B, whereby the ½ modules 10A and 10B can have the ejection timings different from each other. The ejection timings of the nozzles within the same ½ module 10A (or 10B) are substantially the same. In other words, the ink droplets are ejected at the same phase. Even when the ink droplets are ejected by the same nozzle block at the same phase, the ejection timings slightly fluctuate due to the circuit configuration. The ejection timings have been previously described as "substantially the same" to mean that the slight difference in the ejection timings is tolerated. The expression of "substantially the same time" here (substantially the same ejection timings) means a synchronism having a timewise error that falls within the margin for error of droplet deposition positions (grid points of pixels defined based on a record resolution) targeted by the ink droplets to be deposited on an image-rendering medium (paper).

Dividing the nozzle row 16 sharing the common flow channel 25 into the M nozzle groups as described above is referred to as "M division," and a driving aspect where ejection drive is performed in units of the M division nozzle groups is referred to as "M division drive" or "M division ejection".

Figure 4:
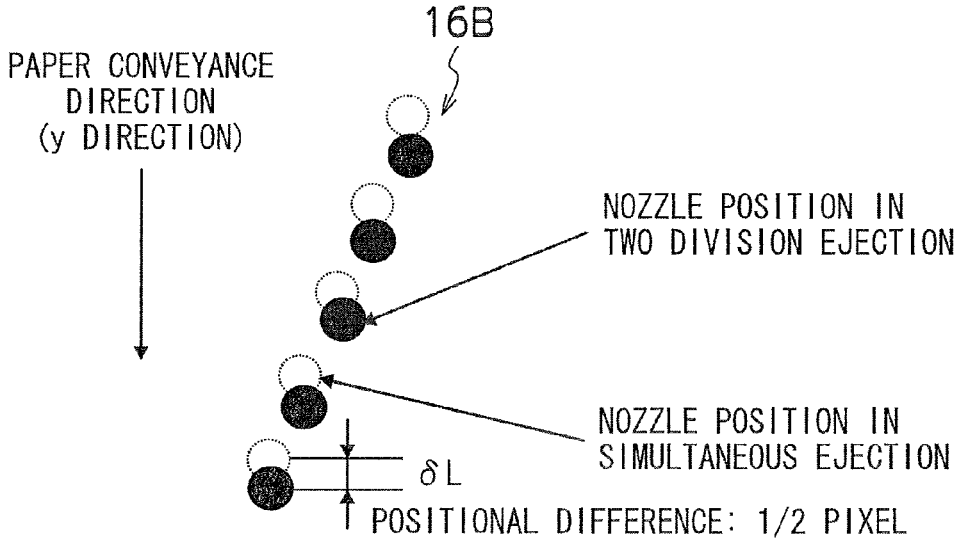
FIG. 4 is an enlarged diagram of a nozzle arrangement in a ½ module 10B shown in FIG. 1.

FIG. 4 is an enlarged diagram of the nozzle arrangement in the lower ½ module 10B shown in FIG. 1. As shown in FIG. 4, a nozzle row 16B of the ½ module 10B of the present embodiment is shifted by δL in the paper conveyance direction (y direction), compared to the imaginary position of a one (no division) row of nozzles (depicted as circles of dashed lines) that would simultaneously eject ink droplets.

For example, when depositing the ink droplets at a recording resolution of 1200 DPI (approximately 21 μm pitch), the nozzle positions are shifted from the imaginary positions of the one row of nozzles simultaneously ejecting the ink droplets, by a shift amount (δL) of ½ pixel (10.6 μm), and the phases of the ejection timings of the ½ modules 10A and 10B are shifted by this amount with each other. "Period" used as the standard of "phase" is a period of ejection corresponding to a pitch of dots (pixels) formed by the ejected ink droplets on the image-rendering medium (paper) having a certain recording resolution.

Figure 5:
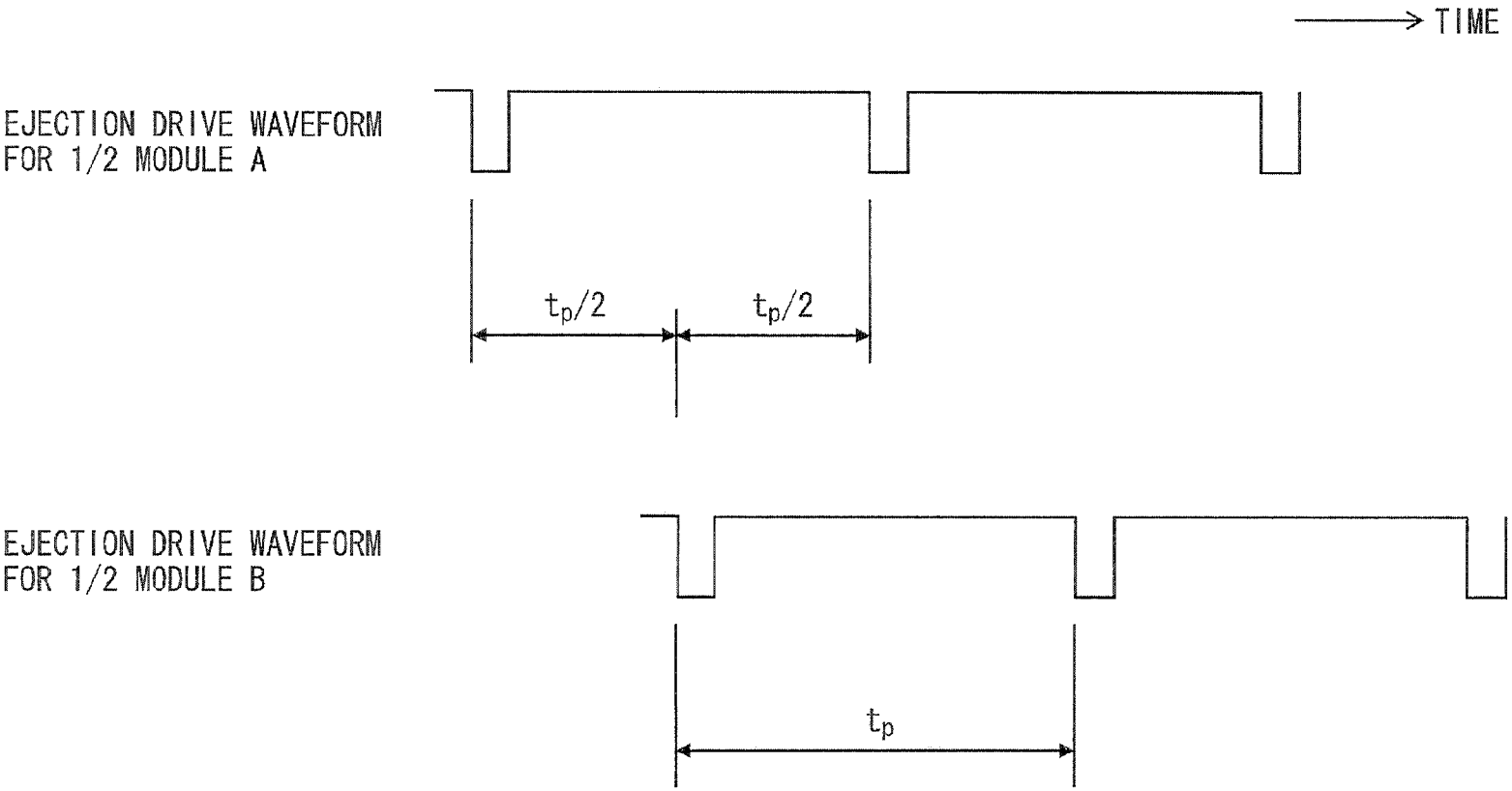
FIG. 5 is a waveform diagram showing an example of a pair of ejection drive waveforms in two division ejection.

FIG. 5 shows an example of a pair of ejection drive waveforms in the two division ejection. As shown in FIG. 5, the phase of the ejection drive waveform applied to the ½ module 10B is shifted by 180 degrees, that is, ½ period ($t_p/2$) with respect to the phase of the ejection drive waveform applied to the ½ module 10A. This phase difference (time difference) corresponds to a positional difference of ½ pixel in the paper conveyance direction (y direction). However, because the nozzles of the ½ module 10B are arranged, in expectation of this positional difference (½ pixel), as described with reference to FIG. 4, the droplet deposition positions (dot deposition positions) on the paper are not shifted in the sub-scanning direction.

In FIG. 5, ejection drive pulses are depicted as simple square pulses for the convenience of explanation, but the drive waveforms are not limited thereto.

Figure 6:
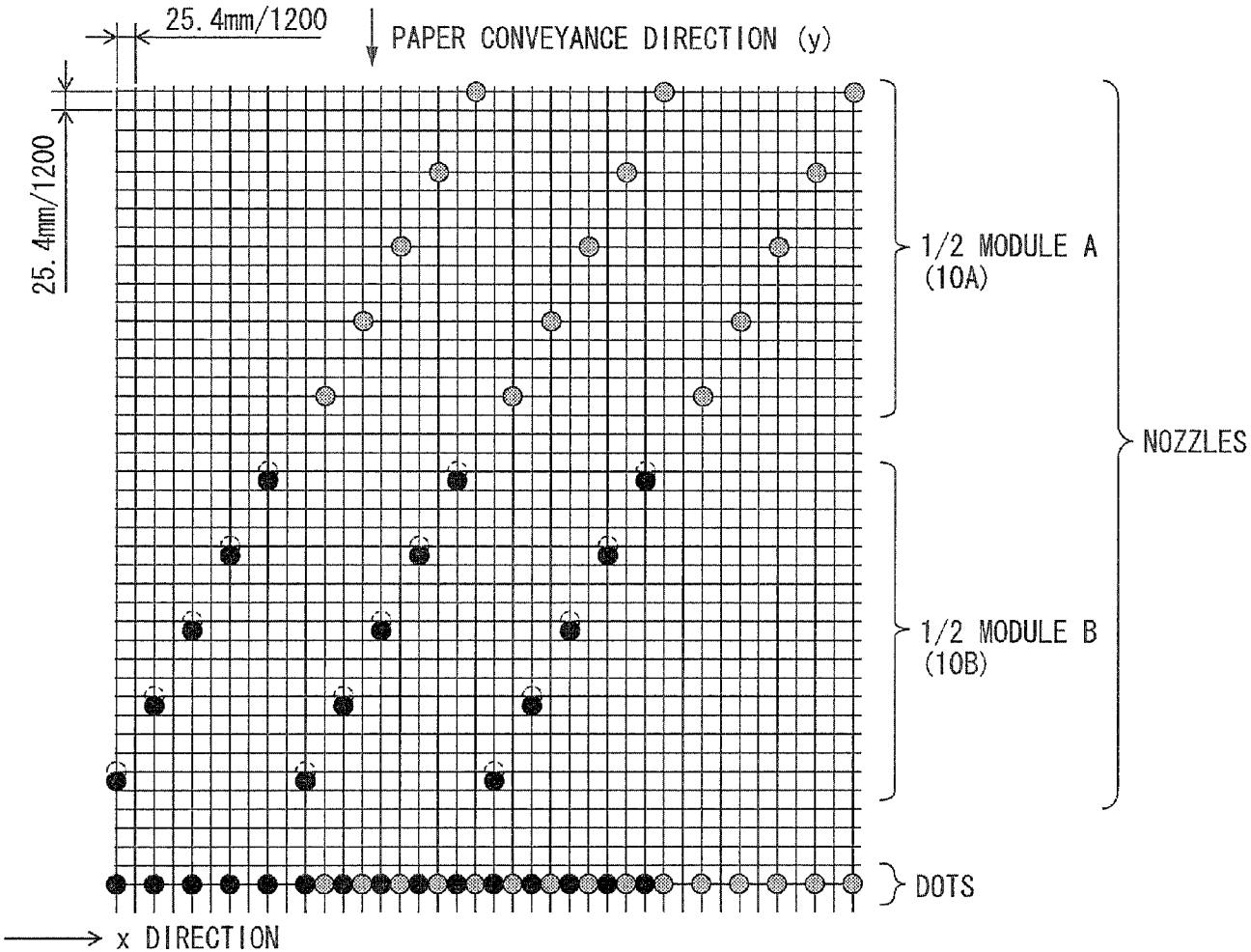
FIG. 6 is an explanatory diagram showing the relationship between a nozzle arrangement in the head module and a dot row rendered by the nozzle arrangement.

FIG. 6 is a diagram showing the relationship between the nozzle arrangement of the head module 10 and a dot row rendered by this nozzle arrangement. Here, the image-rendering medium is conveyed with respect to the head module 10 in the y direction at a constant speed, and when the record resolutions in the main scanning direction (x direction) and the sub-scanning direction (paper conveyance direction: y direction) are 1200 DPI, the grid interval between droplet deposition points (pixels), that is, the pitch of dots (pixels) is 25.4 mm/1200 in both the x direction and the y direction.

When the nozzles belonging to the ½ module 10A are placed on the grid points, ink droplets are ejected from the nozzles of the module 10A. At this moment, the nozzles belonging to the ½ module 10B are placed on the positions shifted from the grid points by ½ pixel in the y direction. Then, since the droplet ejection timing of the ½ module 10B is also shifted by ½ period, the ink droplets ejected by the nozzles belonging to the ½ module 10B are eventually deposited on the grid points. As a result, as shown in the lowermost dot row in FIG. 6, a dot row (rendered image) arranged on the grid points in the same y direction positions can be farmed.

By performing the two division ejection on the head module 10 as described above, the number of nozzles ejecting simultaneously in the same nozzle row can be reduced, and also the effect of crosstalk and the effect of increase in voltage capacity in the drive circuit can be reduced.

FIGS. 1 to 6 illustrate the example of the ½ phase shifting in the two division; however, a ¼ phase shifting in the two division is also possible when implementing the present invention. In terms of the relationship between the division number (M) and the phase difference, the phase is not necessarily divided evenly by the division number. However, when the phase difference is obtained by even division, a great effect of reducing crosstalk is achieved.

Moreover, in FIGS. 1 and 2, ten nozzles per nozzle row 16 are illustrated for the convenience of explanation (five nozzles in each of the modules 10A and 10B), but the number of nozzles per nozzle row, the division number, the division ratio, the number of nozzle rows and the like are not particularly limited when implementing the present invention.

Modification: Example of Four Division

The above embodiment has described the two division ejection; however, the division number of a nozzle row can be two or more, or an appropriate division number can be made. An example of a four division structure is shown in FIG. 7.

Figure 7:
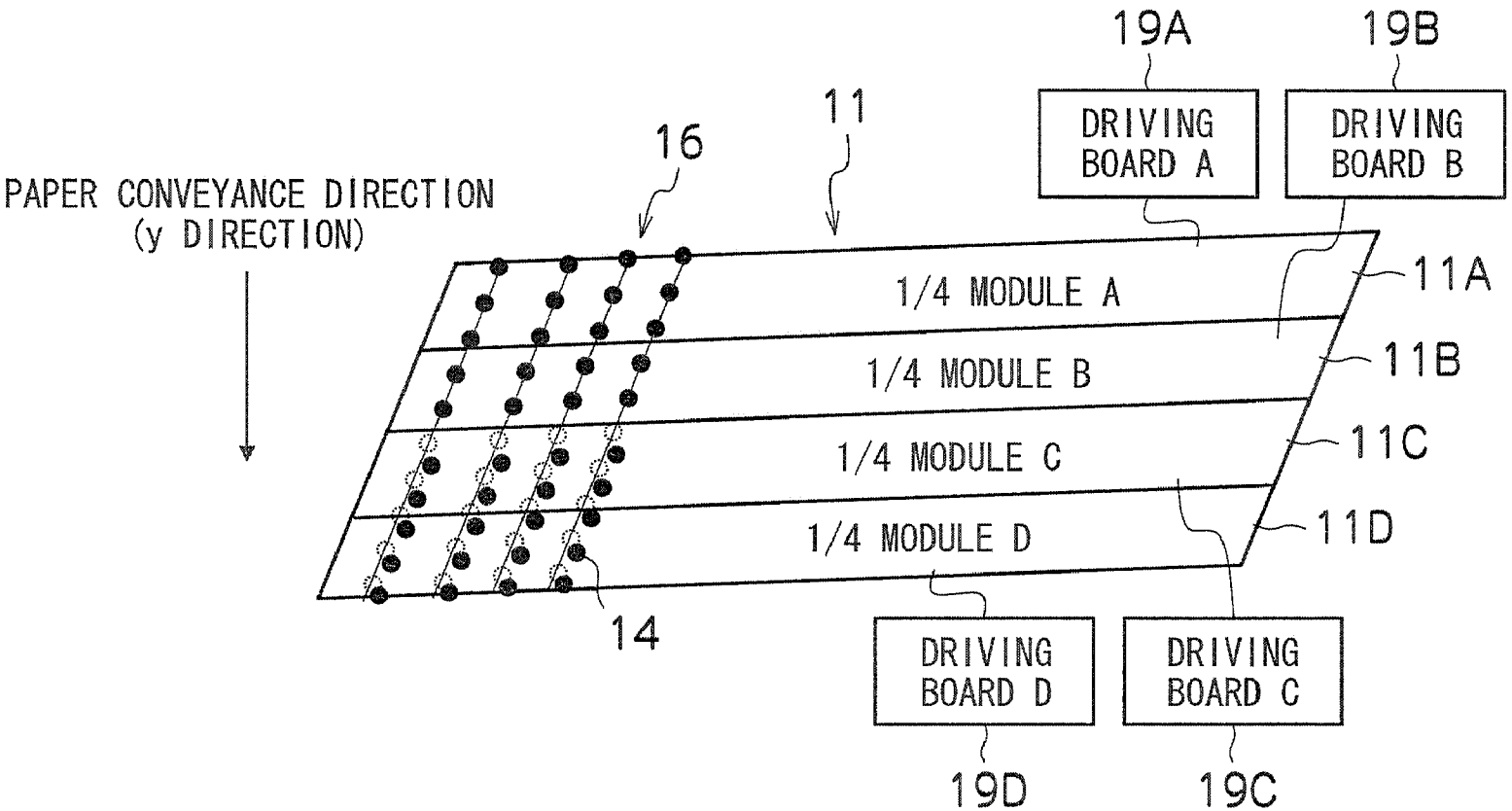
FIG. 7 is a diagram showing a configuration example of the head module in four division.

In FIG. 7, the same reference numerals are applied to the same or similar elements as those of the configuration shown in FIG. 1, and the explanations of these elements are omitted.

In the case of a head module 11 having the four division structure, a ¼ module 11A, a ¼ module 11B, a ¼ module 11C and a ¼ module 11D are provided with driving boards 19A, 19B, 19C and 19D, respectively, to provide phase differences to the ejection timings of the respective modules. The positions of the nozzles arranged in the ¼ modules 11B, 11C and 11D are shifted based on the phase differences, respectively.

Figure 8A:
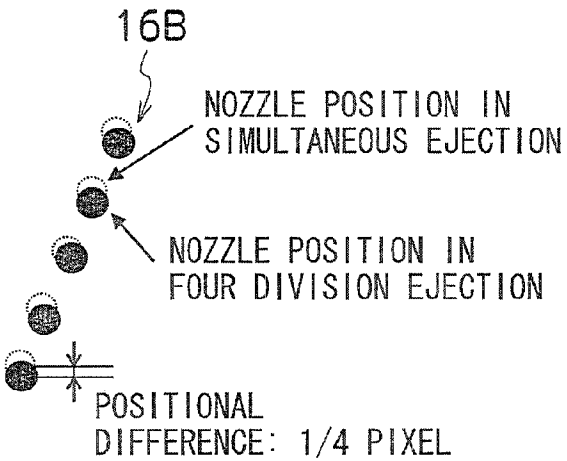
FIGS. 8A to 8C are enlarged diagrams of nozzle arrangements in ¼ modules 11B to 11D shown in FIG. 7.
Figure 8B:
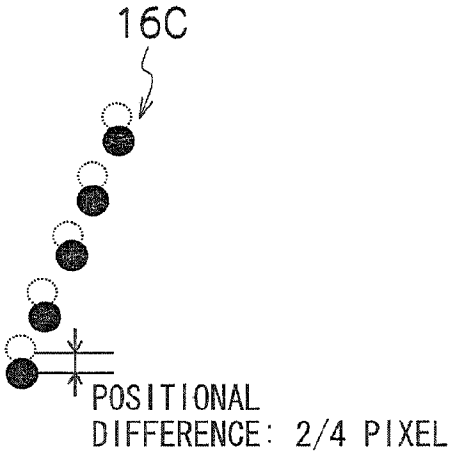
Figure 8C:
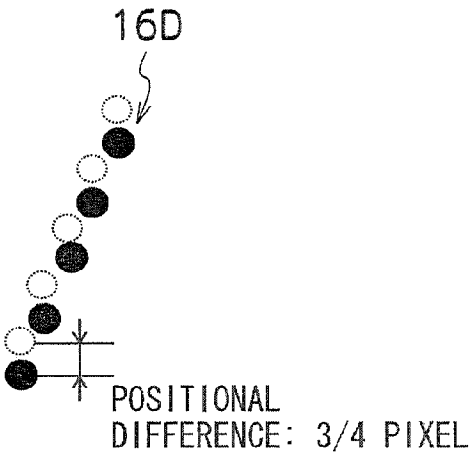

FIGS. 8A, 8B and 8C are enlarged diagrams of a nozzle arrangement of the ¼ module 11B, a nozzle arrangement of the ¼ module 11C, and a nozzle arrangement of the ¼ module 11D, respectively.

As shown in FIGS. 8A, 8B and 8C, compared to the imaginary positions of one (no division) row of nozzles (depicted as circles of dashed lines in FIGS. 8A, 8B and 8C) that would simultaneously eject ink droplets, a nozzle row 16B of the ¼ module 11B is shifted by ¼ pixel in the paper conveyance direction (y direction), a nozzle row 16C of the ¼ module 11C is shifted by ¾ pixel, and a nozzle row 16D of the ¼ module 11D is shifted by ¾ pixel.

Figure 9:
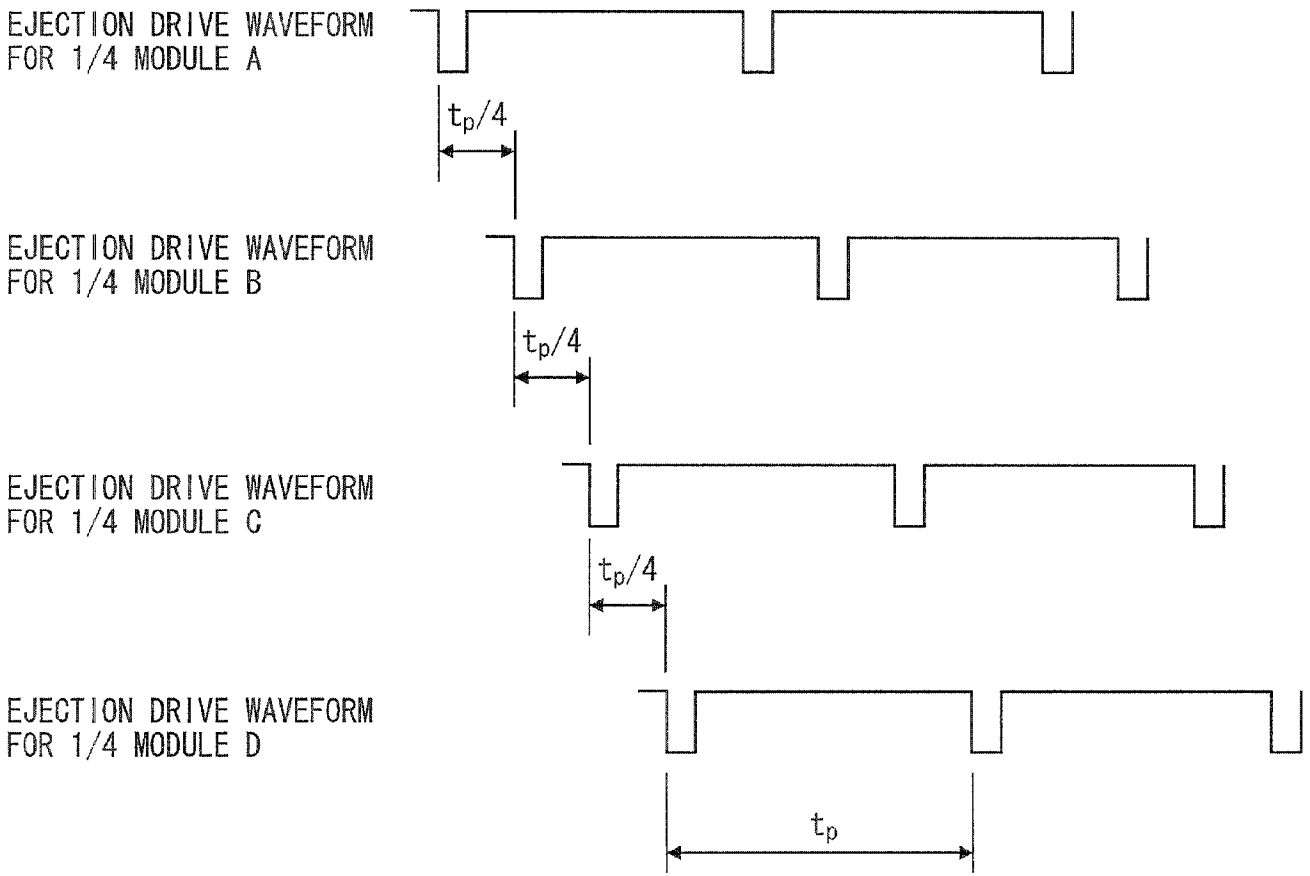
FIG. 9 is a waveform diagram showing an example of a set of ejection drive waveforms in four division ejection.

FIG. 9 shows an example of a set of ejection drive waveforms in the four division ejection. As shown in FIG. 9, the phase of the ejection drive waveform applied to the ¼ module 11B is shifted by ¼ period ($t_p/4$) with respect to the phase of the ejection drive waveform applied to the ¼ module 10A. Similarly, the phase of the ejection drive waveform applied to the ¼ module 11C is shifted by ¼ period ($t_p/4$) with respect to the phase of the ejection drive waveform applied to the ¼ module 10B, and the phase of the ejection drive waveform applied to the ¼ module 11D is shifted by ¼ period ($t_p/4$) with respect to the phase of the ejection drive waveform applied to the ¼ module 10C.

By performing the four division ejection in this manner, the effect of crosstalk and the effect of increase in voltage capacity in the drive circuit can be reduced more effectively.

Technology of N-Multiple Rendering (N≧2)

Next will be described a method for favorably reducing the fluctuation of the droplet amount or droplet speed in one nozzle row by carrying out multiple rendering using a two-dimensional nozzle array.

<Non N-Multiple Rendering (N≧2) (Single Rendering)>

First of all, for comparison, an example of non N-multiple rendering is described with reference to FIG. 10. In the two-dimensional nozzle array shown in FIG. 10, diagonal nozzle rows 52-1, 52-2 and 52-3 are not overlapped on one another in the x direction. The first nozzle row 52-1 completes a dot line of a region S1, the second nozzle row 52-2 completes a dot line of a region S2, and the third nozzle row 52-3 completes a dot line of a region S3.

In other words, a line head (a virtual nozzle arrangement) that is in charge of recording the region S1 is fanned by the first nozzle row 52-1, and a line head that is in charge of recording the region S2 is formed by the second nozzle row 52-2. As a result, the nozzle rows 52-*i* (i=1, 2, 3, . . . ) are connected to form a single line in the x direction.

In this manner, for any region on the paper (image-rendering medium), dots are formed by the single nozzle line, and, as a result, all of the dots formed by one nozzle row are arranged adjacent to each other. Such a rendering aspect is referred to as "non N-multiple rendering (single rendering)."

Figure 10:
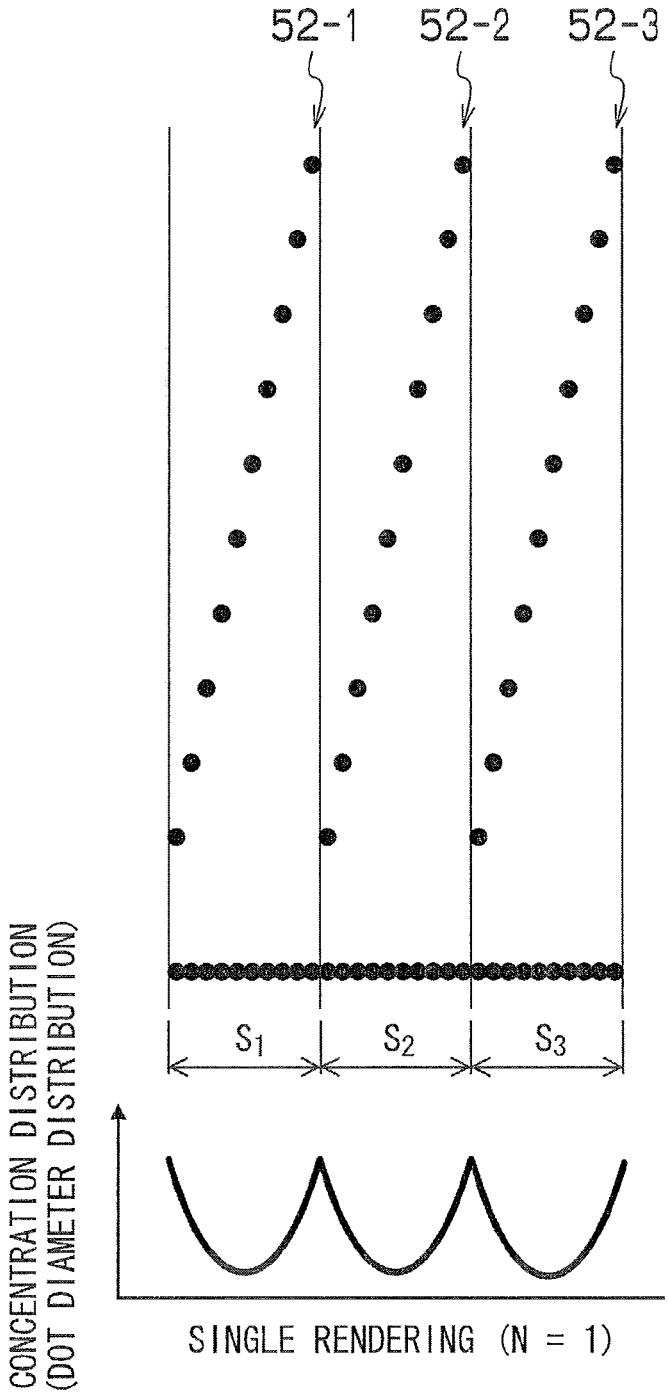
FIG. 10 is an explanatory diagram of a rendering example (single rendering) that is not N-multiple rendering (N>2)

In the line head that has this two-dimensional nozzle array, when the nozzles of each nozzle row share each ink supply flow channel, the concentration distribution (dot diameter distribution) used for rendering reflects the distribution (fluctuation) of the droplet speed or droplet amount generated in each nozzle row on the basis of the period of the nozzle rows, as shown in the graph at the bottom of FIG. 10.

<Examples of N-Multiple Rendering (N≧2)>

FIGS. 11 to 19 show examples of N-multiple rendering. As shown in FIGS. 11 to 19, N-multiple rendering (N≧2) means a state in which a dot line formed in a certain region on the image-rendering medium is rendered by N nozzle rows (N≧2).

Figure 11:
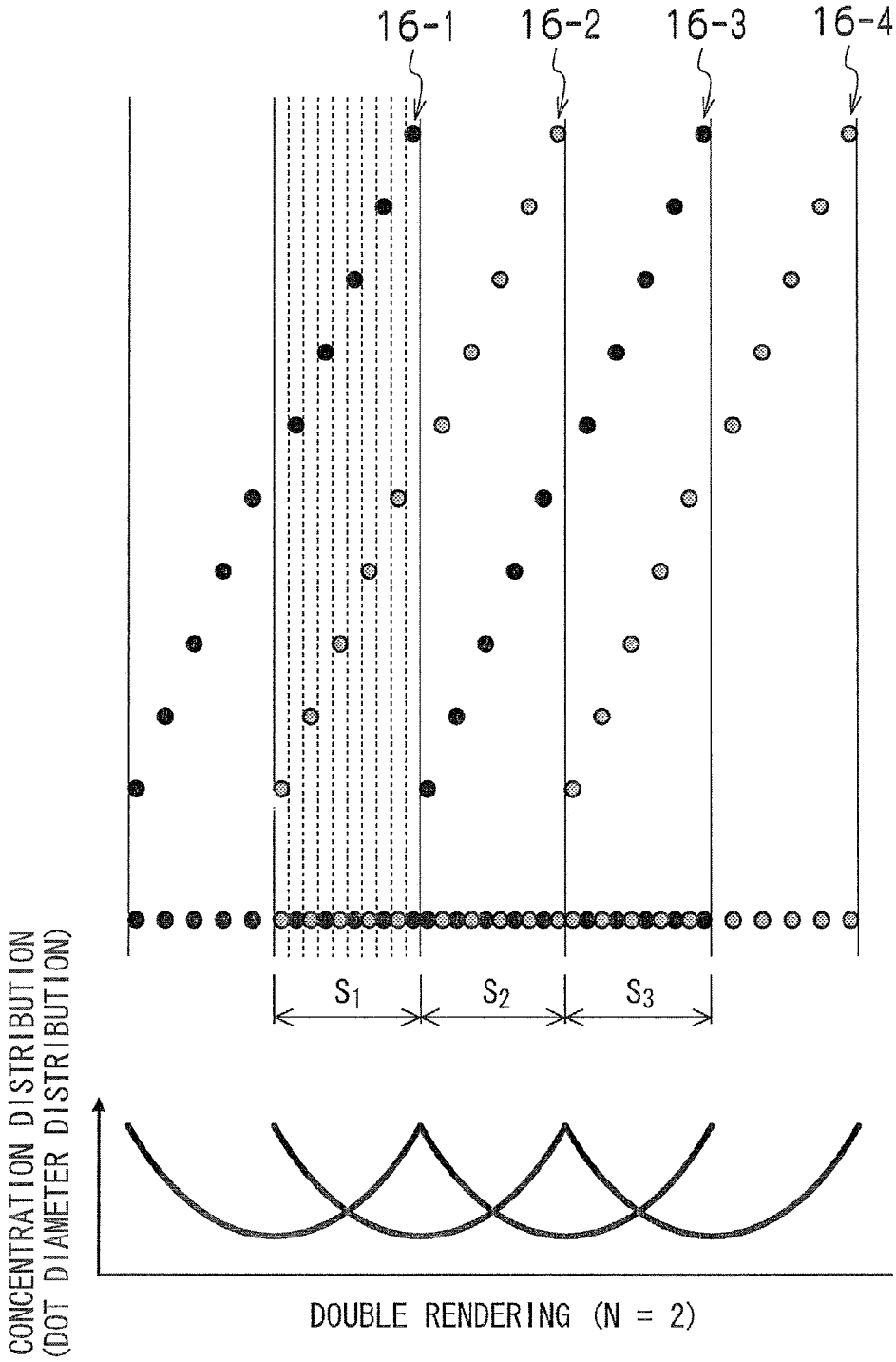
FIG. 11 is an explanatory diagram of a double rendering (no division)

In FIG. 11 showing an example of double rendering, the region S1 of a dot line extending in the x direction is rendered by upper five nozzles of a nozzle row 16_1 and lower five nozzles of a nozzle row 16_2. The region S2 is rendered by upper five nozzles of the nozzle row 16_2 and lower five nozzles of a nozzle row 16_3. Similarly, in the region S3 as well, one dot line is foamed by alternately depositing dots by means of nozzles belonging to two nozzle rows.

In this manner, N-multiple rendering can be performed by a two-dimensional nozzle array in which the nozzle rows adjacent to each other in the x direction are partially overlapped on each other in the x direction and in which the positions of the nozzles are not overlapped in the x direction.

By performing N-multiple rendering, although fluctuations are similarly generated respectively in the N nozzle rows, the fluctuations are averaged by the distributions shifted from each other so that the moving average is obtained (this effect is referred to as "averaging effect"), and thereby the fluctuation range of the concentration distribution is reduced. As a result, concentration variation caused by the fluctuation in the droplet amount, and jagged lines generated by the fluctuation in the droplet speed (deposition position fluctuation) can be favorably reduced.

Figure 12:
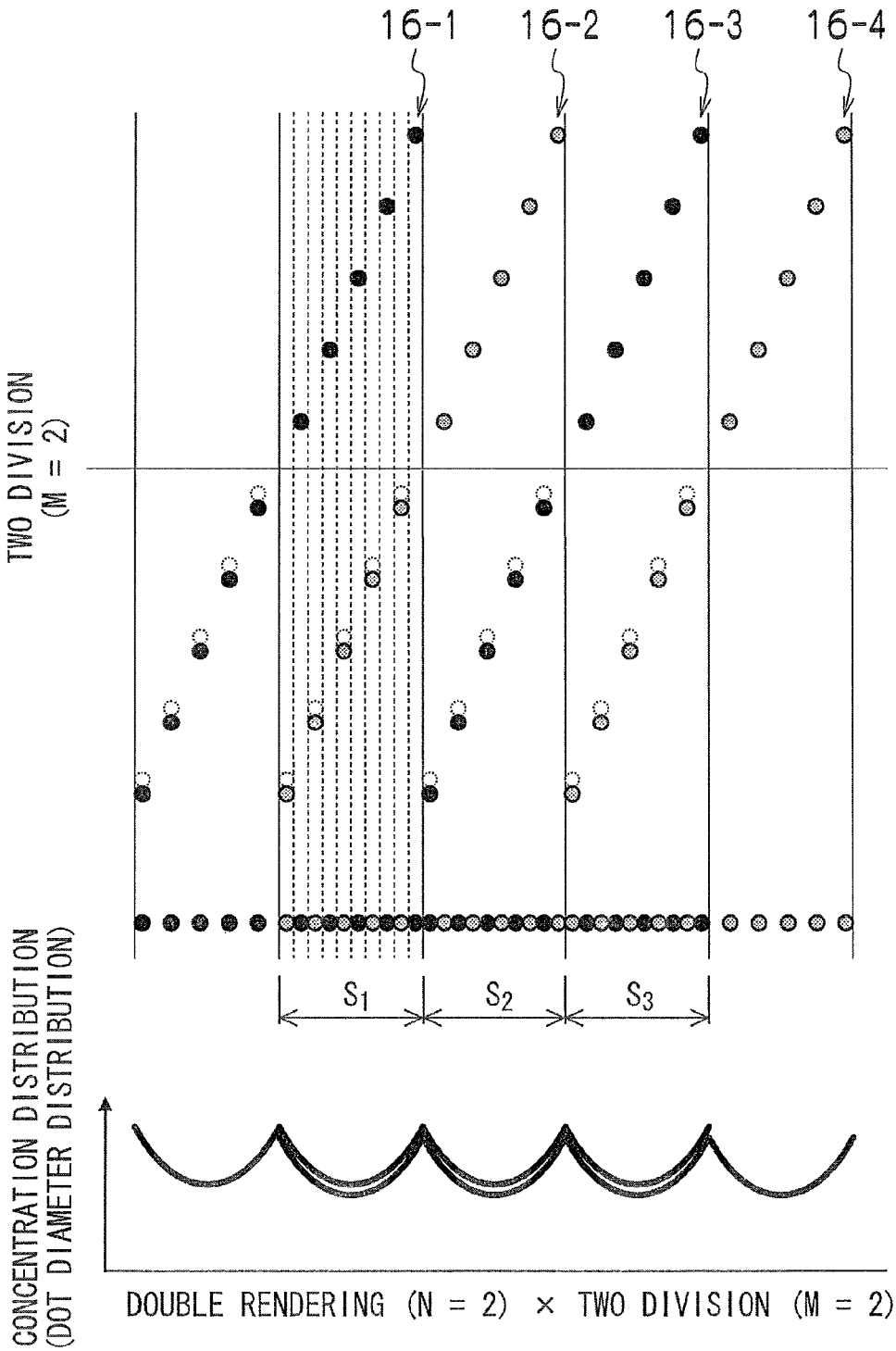
FIG. 12 is an explanatory diagram of a rendering example in which double rendering and two division are performed.

FIG. 12 shows an example of N-multiple rendering (N≧2) adopted in the present embodiment.

FIG. 12 shows an example of double rendering (N=2) and two division (M=2). As is clear when comparing it to the aspect of double rendering (N=2) with no division (M=1) shown in FIG. 11, in the example shown in FIG. 12 to which the embodiment of the present invention is applied, the concentration fluctuation (amplitude) is reduced, and the spatial period of the concentration distribution is also reduced (i.e., the spatial frequency is increased). Therefore, the concentration variation is not very visible, and high quality images can be formed.

Figure 13:
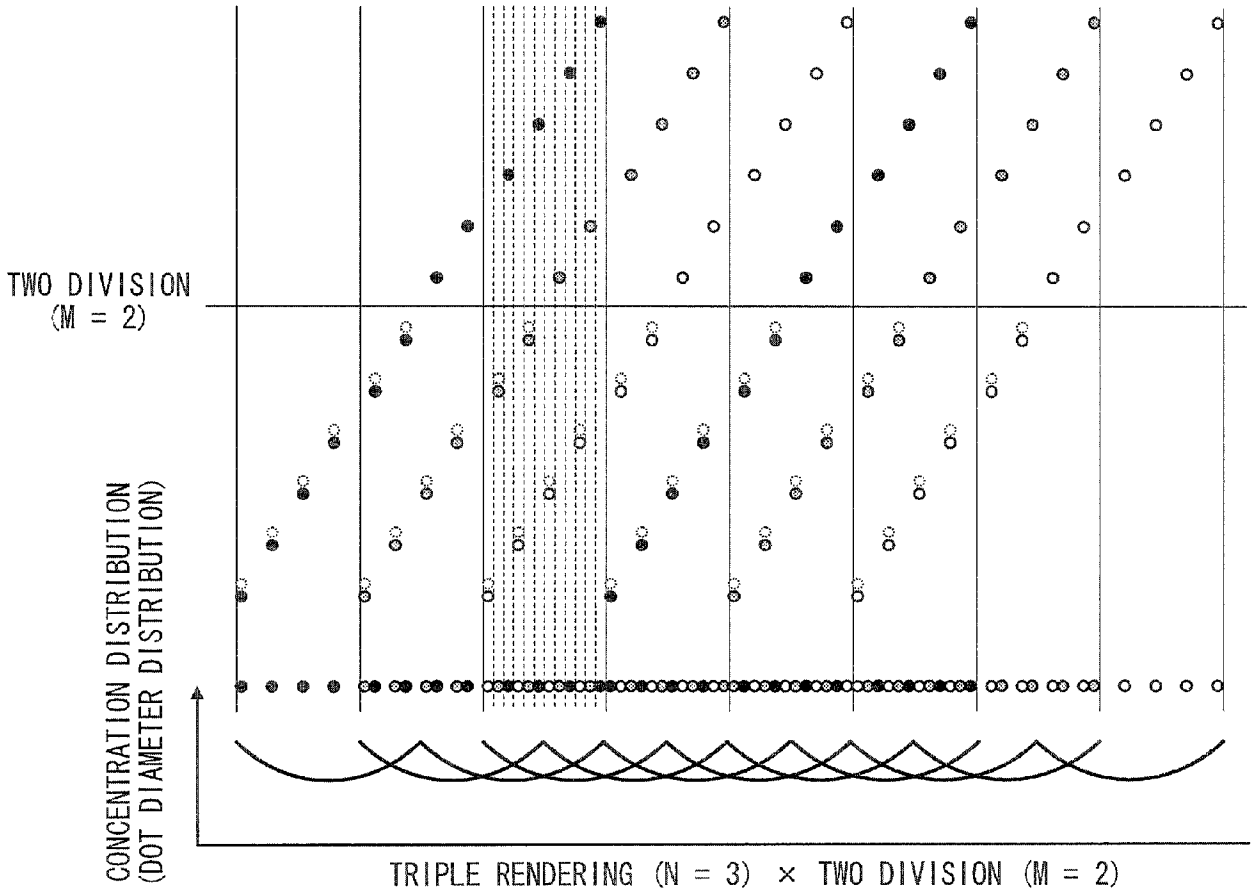
FIG. 13 is an explanatory diagram of a rendering example in which triple rendering and two division are performed.
Figure 14:
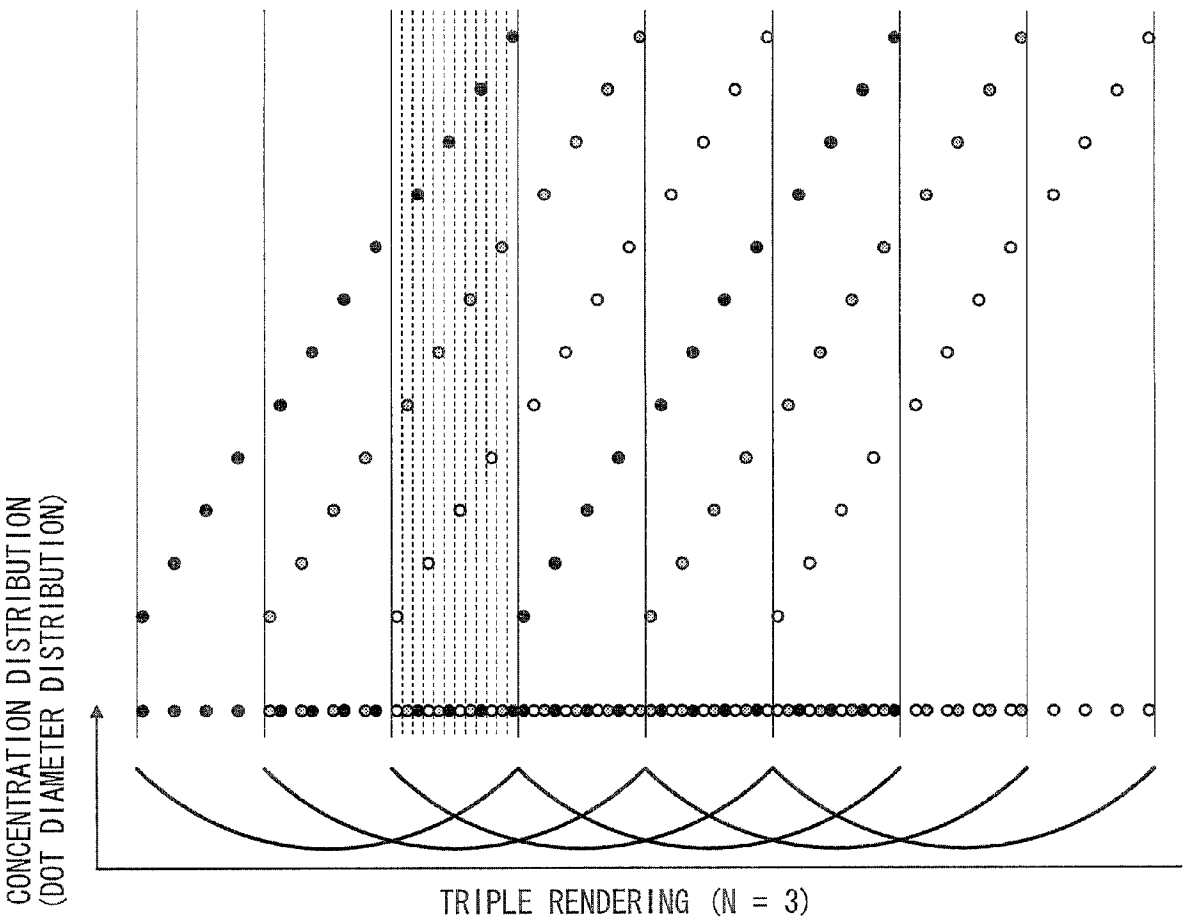
FIG. 14 is an explanatory diagram of triple rendering (no division)

FIG. 13 shows an example of triple rendering (N=3) and two division (M=2). As is clear when comparing it to an aspect of triple rendering (N=3) and no division (M=1) shown in FIG. 14, in the example shown in FIG. 13, the concentration fluctuation (amplitude) is reduced, and the spatial period of the concentration distribution is also reduced (i.e., the spatial frequency is increased). Therefore, the concentration variation is not very visible. In addition, the concentration distribution is further averaged, compared to the example of double rendering shown in FIG. 12.

Figure 15:
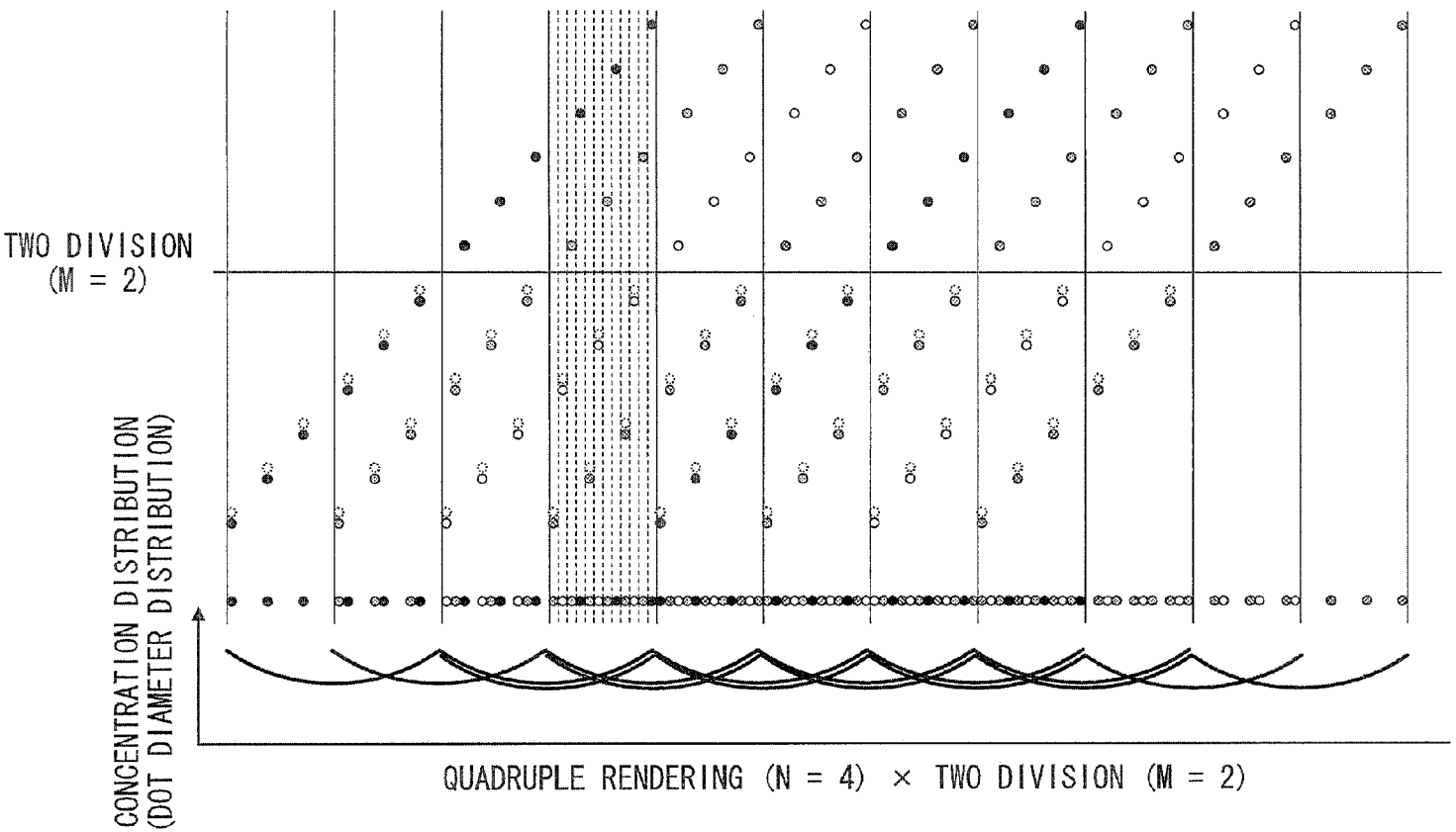
FIG. 15 is an explanatory diagram of a rendering example in which quadruple rendering and two division are performed.
Figure 16:
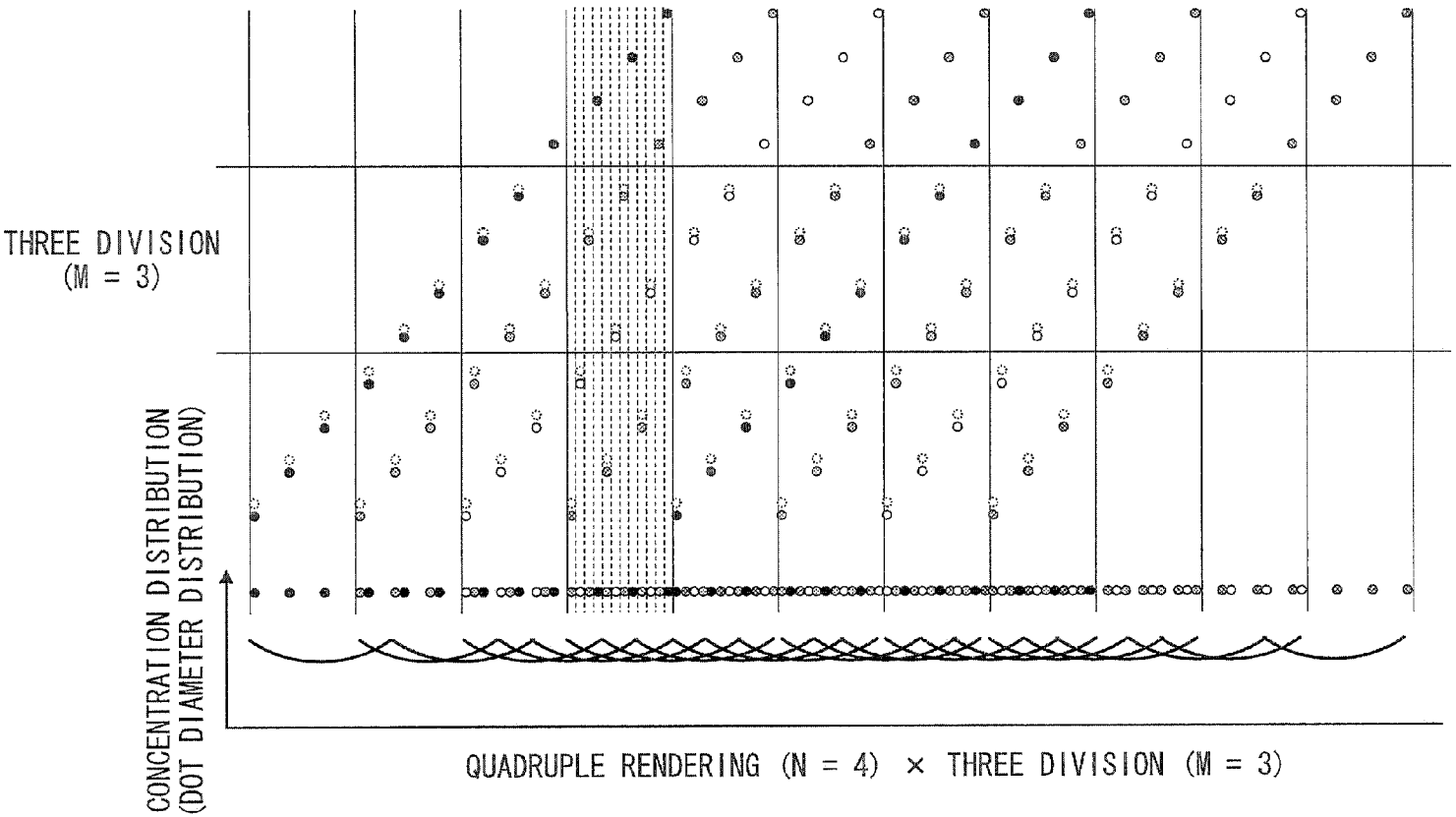
FIG. 16 is an explanatory diagram of a rendering example in which quadruple rendering and three division are performed.
Figure 17:
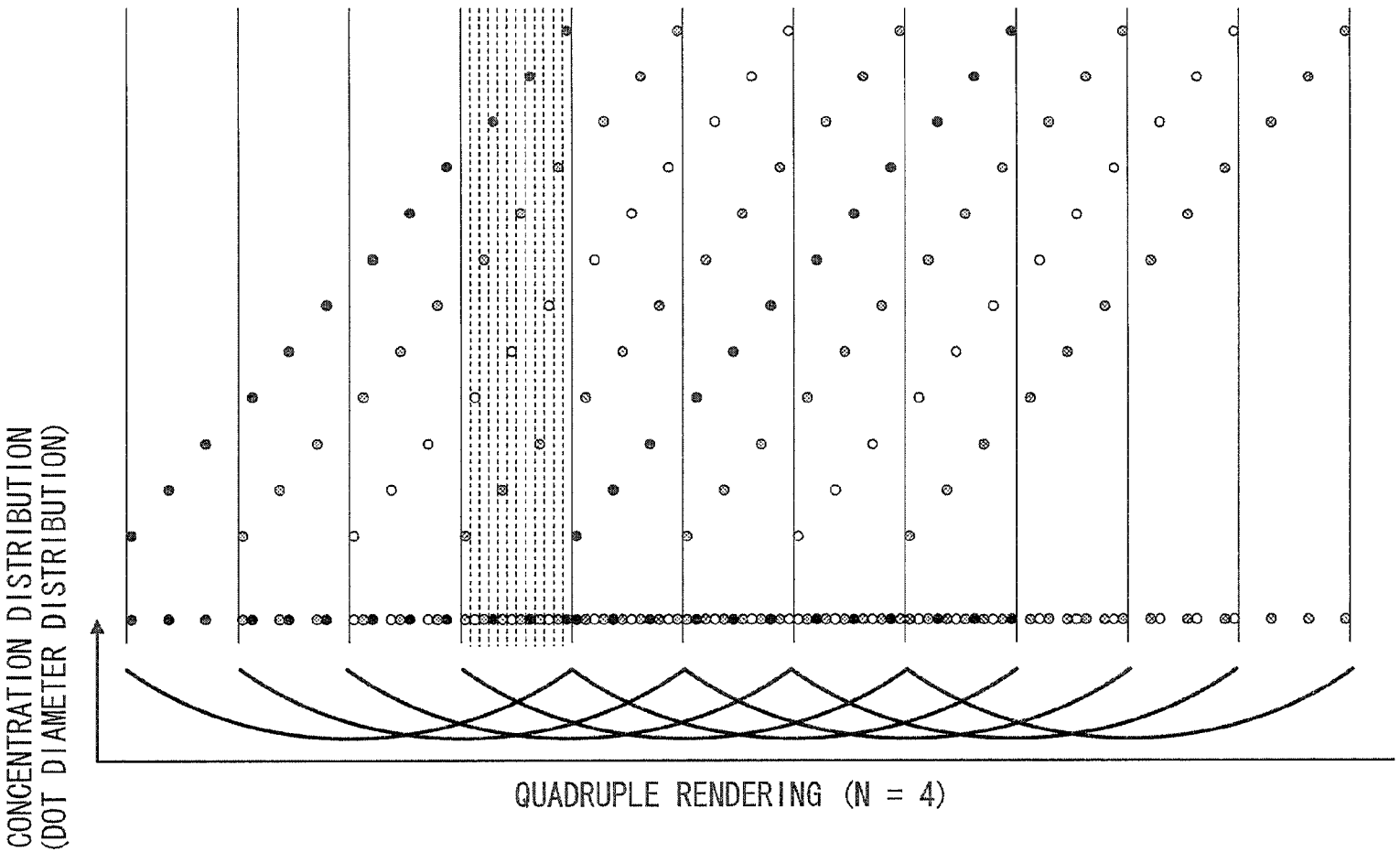
FIG. 17 is an explanatory diagram of quadruple rendering (no division)

FIG. 15 shows an example of quadruple rendering (N=4) and two division (M=2), and FIG. 16 an example of quadruple rendering (N=4) and three division (M=3). As is clear when comparing them to the aspect of quadruple rendering (N=4) and no division (M=1) shown in FIG. 17, in the examples shown in FIGS. 15 and 16, the concentration fluctuation (amplitude) is reduced, and the spatial period of the concentration distribution is also reduced (i.e., the spatial frequency is increased). Therefore, the concentration variation is not very visible. In addition, in the example of the three division shown in FIG. 16, the concentration distribution is further averaged, compared to the example of the two division shown in FIG. 15.

Figure 18:
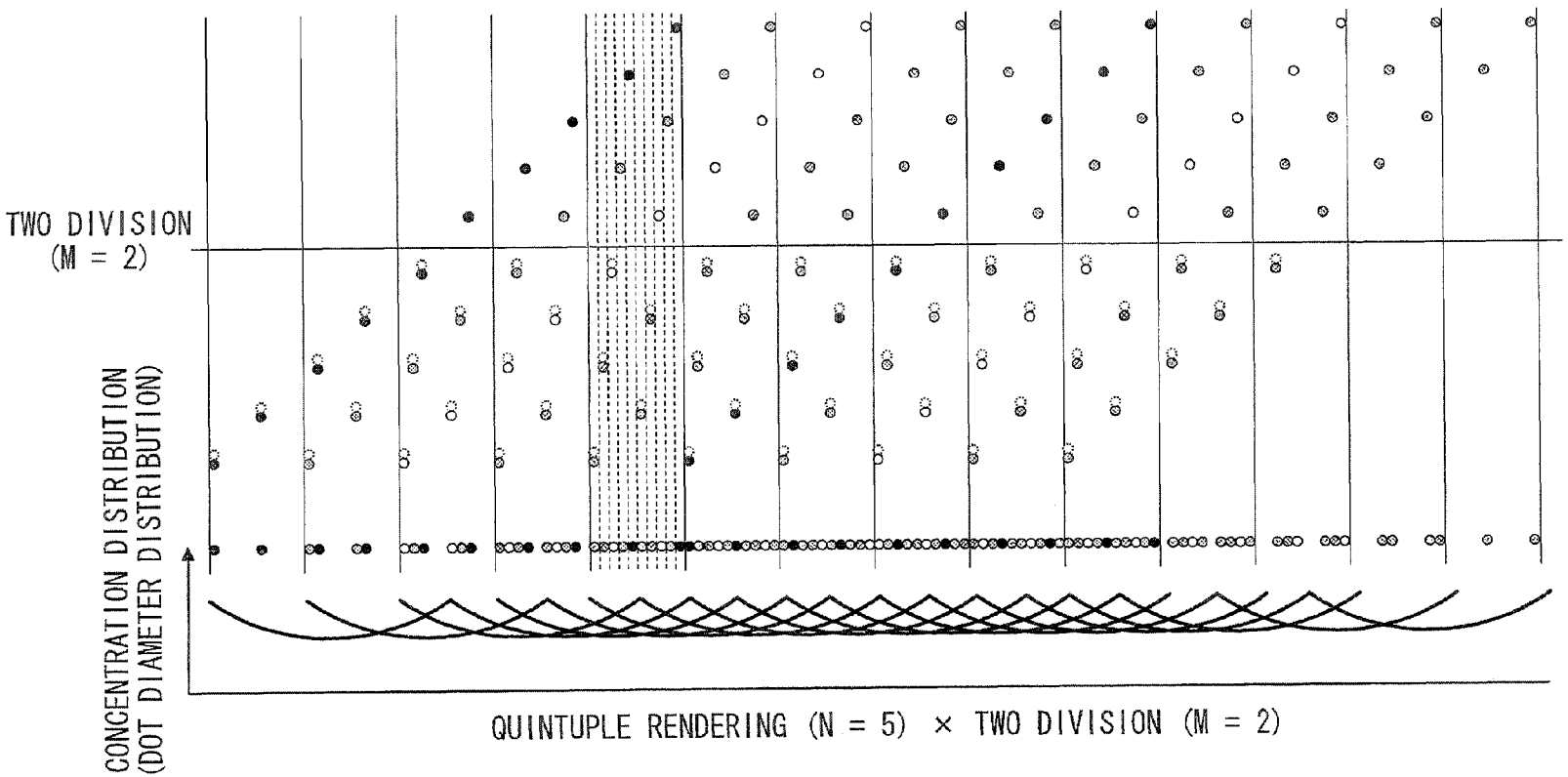
FIG. 18 is an explanatory diagram of a rendering example in which quintuple rendering and two division are performed.
Figure 19:
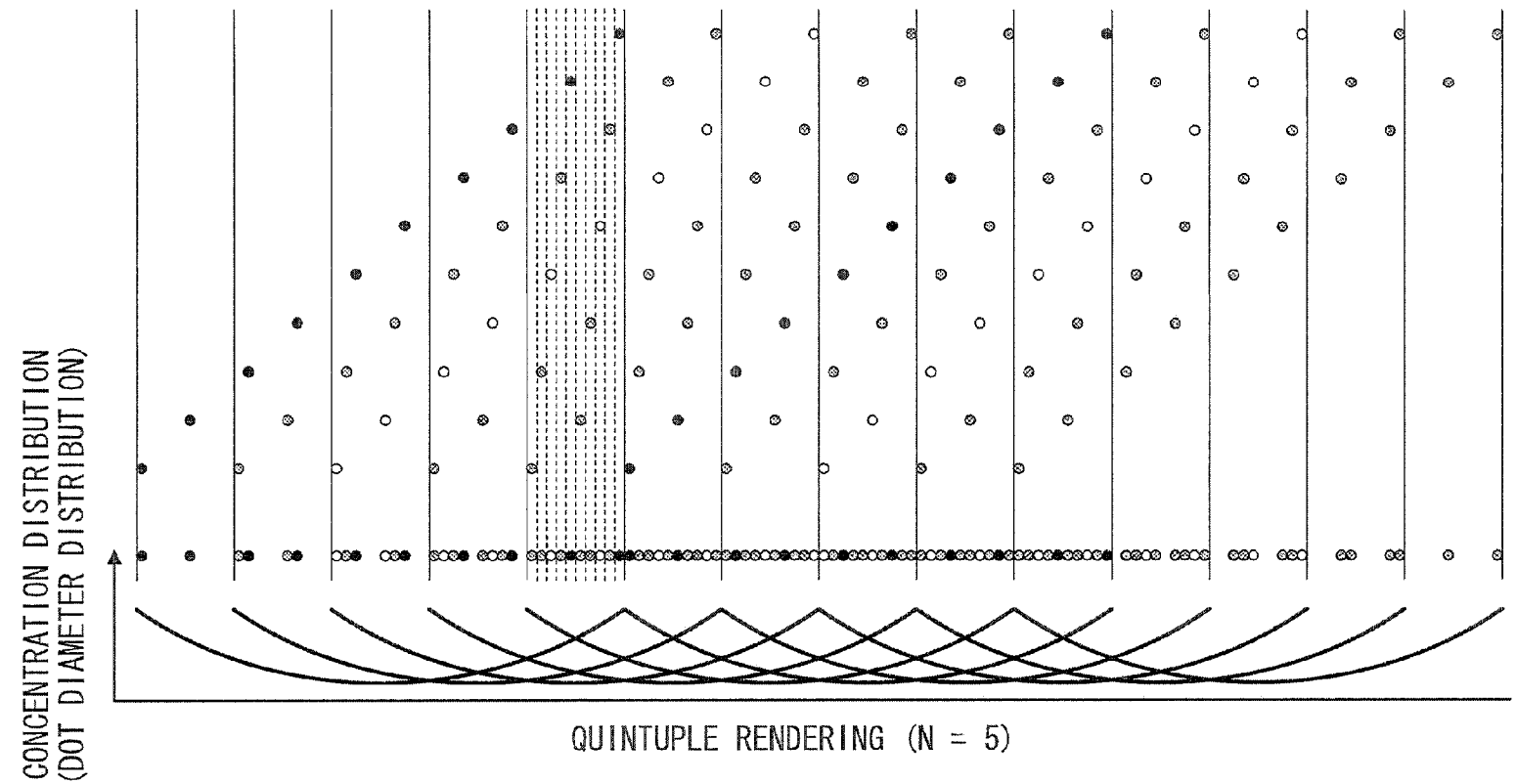
FIG. 19 is an explanatory diagram of quintuple rendering (no division)

FIG. 18 shows an example of quintuple rendering (N=5) and two division (M=2). As is clear when comparing it to an aspect of quintuple rendering (N=5) and no division (M=1) shown in FIG. 19, in the example shown in FIG. 18, the concentration fluctuation (amplitude) is reduced, and the spatial period of the concentration distribution is also reduced (i.e., the spatial frequency is increased). Therefore, the concentration variation is not very visible. In addition, the concentration distribution is further averaged, compared to the example of quadruple rendering shown in FIG. 15.

As described above, the combinations of (N, M) in the rendering aspects where N-multiple rendering with M division is performed can be designed in various ways. Especially by adopting a combination in which N and M are prime to each other, the concentration distribution periods corresponding to the nozzle rows of the respective division modules are not overlapped on each other, whereby a higher averaging effect can be obtained.

Elongation of Head

A main scanning direction nozzle line corresponding to the maximum paper width can be realized using the head module 10 illustrated in FIG. 1 alone or the head module 11 illustrated in FIG. 7 alone. Alternatively, for example, as shown in FIG. 20, a plurality of the head modules 10 (or 11) having a substantially parallelogram planar shape can be arranged and connected in the paper widthwise direction, to thereby obtain an elongated line head 80 that realizes a main scanning direction nozzle line corresponding to a recording range of the maximum paper width Wm of an image-rendering medium 62.

Figure 20:
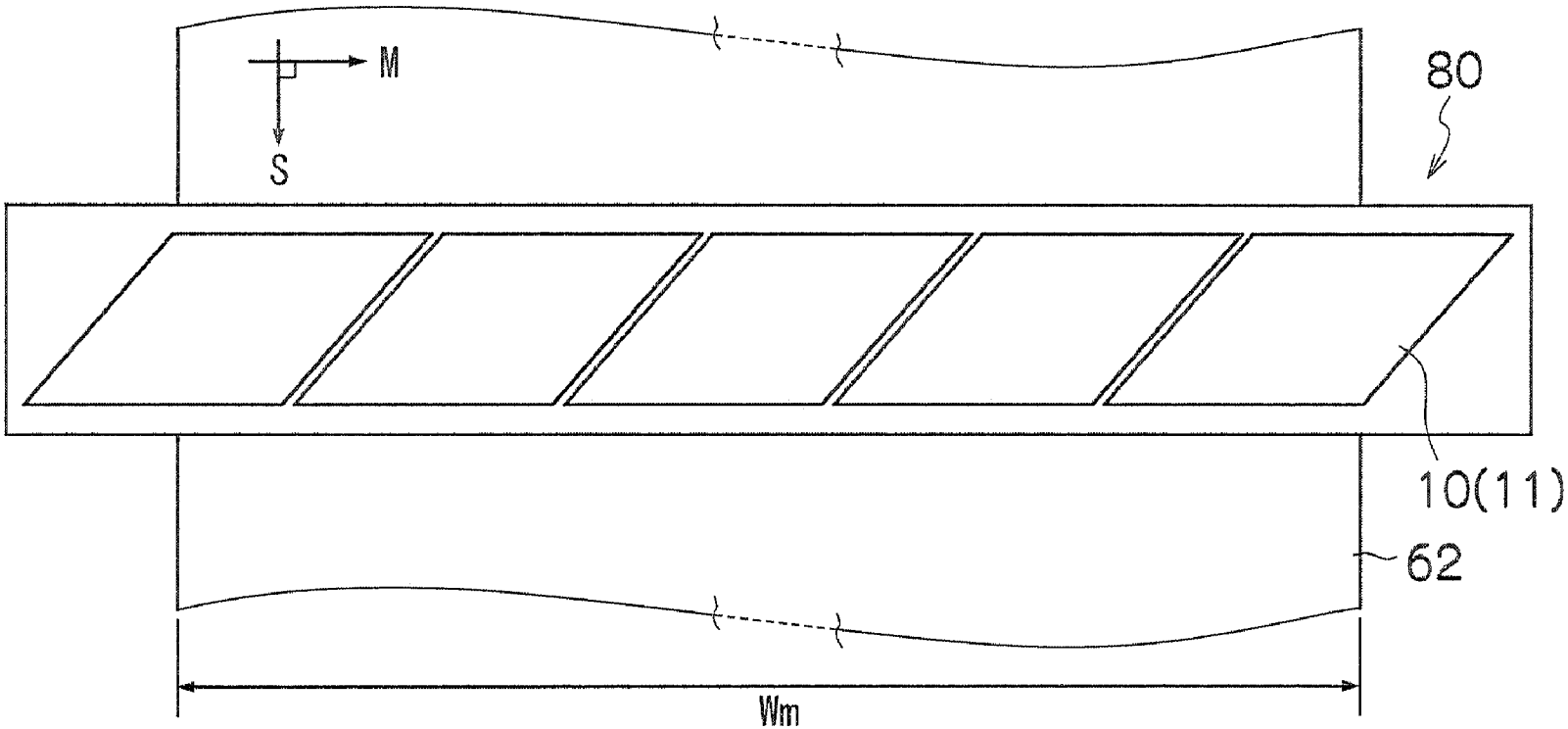
FIG. 20 is a diagram showing a configuration example of a full-line type line head.

When connecting the plurality of head modules to configure the elongated line head 80 as shown in FIG. 20, a particularly simple configuration used is to divide each nozzle row into two in the paper conveyance direction (see FIG. 1).

Operational Effects Obtained by Embodiments

According to the present embodiments, a nozzle row sharing one ink supply flow channel (common flow channel 25) is divided into M (M≧2) nozzle groups (M division). Each group is driven by an individual drive circuit system (each of the driving boards 18A, 18B and 19A to 19D). The ejection timings of the nozzles in the same group have the same phase (are substantially the same). The ejection timings of the different groups are different from each other by a phase difference (M division drive). The positions of the nozzles in the groups are shifted in a relative movement (scanning) direction (the paper conveyance direction shown in FIG. 1: y direction) by the amount corresponding to the phase difference between the ejection timings (shifting of the nozzle positions). In the two-dimensionally arrayed nozzles, the nozzle arrangement is designed so that at least one dot is formed on the image-rendering medium by at least one row of nozzles between dots corresponding to adjacent nozzles of a different row of nozzles, whereby the dots of the adjacent nozzles of one row are not arranged continuously, that is, the dots are arranged with an interval of N (N≧2) (N-multiple rendering).

The following operational effects are achieved by such a configuration.

<1> Nozzles that belong to a nozzle row receiving a supply of ink from the same common flow channel are divided into M blocks, and the ejection timings are shifted for the blocks so that the number of nozzles ejecting the ink simultaneously in the nozzle row connected to the same common flow channel is reduced, whereby the crosstalk effects are reduced and the power source capacity can be lowered.

Examples of the crosstalk effects include: (1) decrease in concentration caused by a decrease in the droplet amount; (2) concentration fluctuation caused by the droplet amount distribution within the nozzles connected to the same common flow channel; (3) jagged lines (raggedness) resulting from the shifting of the deposition positions caused by the decrease in the droplet speed; and (4) raggedness resulting from the periodical shifting of the deposition positions caused by the droplet speed distribution within the nozzles connected to the same common flow channel. The present embodiments can reduce these effects and improve the image quality.

<2> By performing N-multiple rendering in a two-dimensional nozzle array, the crosstalk effects can be reduced favorably. The reduction effect is particularly significant when N and M are set to be prime to each other, for example, (N, M)=(2, 3), (3, 2), (5, 2), (4, 3), etc.

<3> Due to the configuration having the shifting of the nozzle positions, although the ejection timings are shifted between the blocks, the deposition positions are not shifted. Therefore, not only is it possible to deposit ink droplets onto the correct positions, but also the line raggedness and the roughness and fluctuations caused by the phase shifting on the screen can be prevented.

Example of Application to Inkjet Recording Device

An example of an image forming apparatus that uses the head modules mentioned above will be described next.

Figure 21:
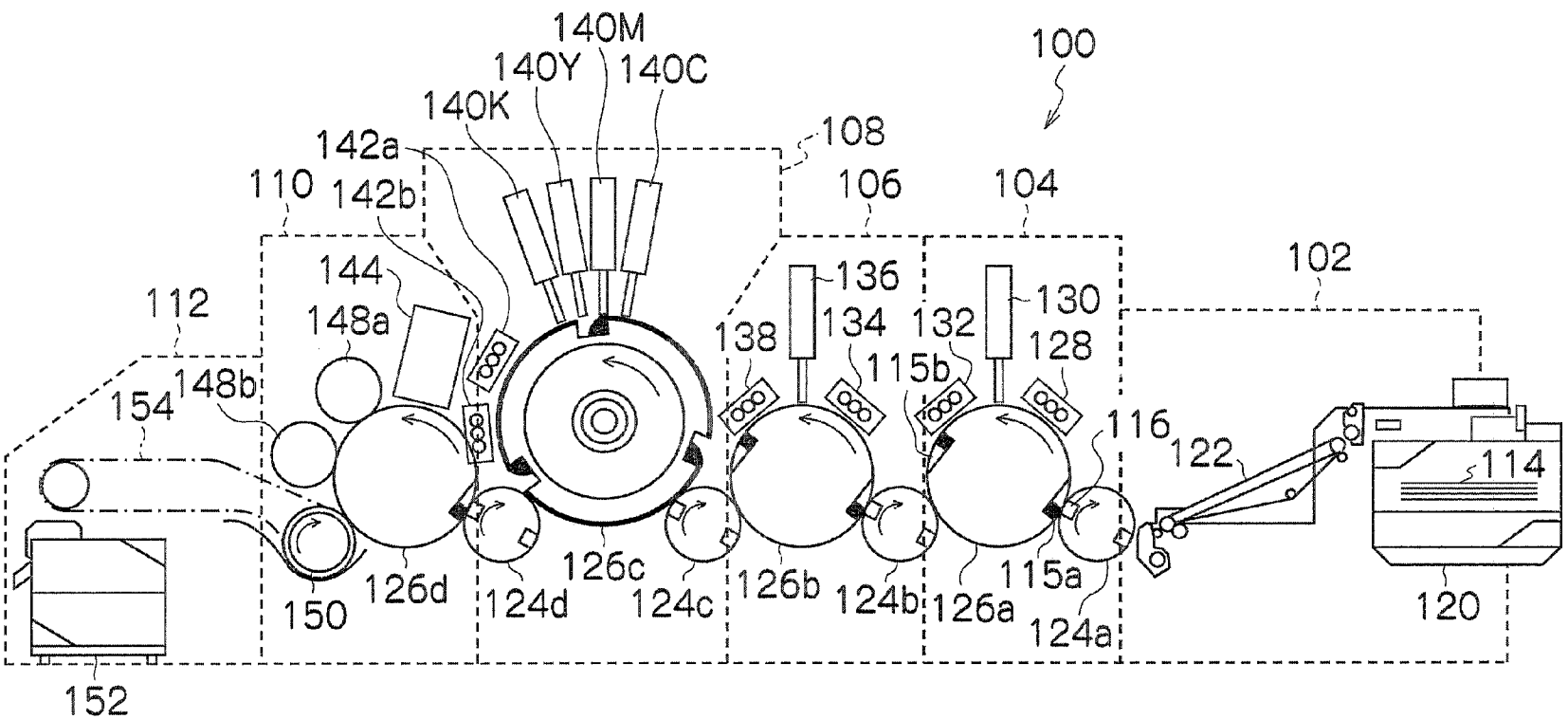
FIG. 21 is a configuration diagram showing the entire inkjet recording device according to the embodiment of the present invention.

FIG. 21 is a schematic drawing of the composition of an inkjet recording apparatus 100 according to an embodiment of the present invention. The inkjet recording apparatus 100 adopts a pressure drum direct rendering system which directly deposits droplets of ink of a plurality of colors onto a recording medium (also referred to as "paper" for convenience) 114 held on a pressure drum 126*c* of an ink ejection unit 108 to form a desired color image, and is an on demand type recording apparatus that uses the two liquid reaction (aggregation) system that uses the ink and treatment liquid (aggregation treatment liquid) to form images on the recording medium 114 of paper sheets.

The inkjet recording apparatus 100 principally includes: a paper supply unit 102 which supplies the recording medium 114; a permeation suppression agent deposition unit 104 which deposits permeation suppression agent on the recording medium 114; a treatment liquid deposition unit 106 which deposits treatment liquid onto the recording medium 114; an ink ejection unit 108 which ejects and deposits droplets of ink onto the recording medium 114; a fixing unit 110 which fixes an image recorded on the recording medium 114; and a paper output unit 112 which conveys and outputs the recording medium 114 on which an image has been formed.

A paper supply platform 120 on which recording media 114 is stacked is provided in the paper supply unit 102. A feeder board 122 is connected to the front of the paper supply platform 120 (the left-hand side in FIG. 21), and the recording media 114 stacked on the paper supply platform 120 is supplied one sheet at a time, successively from the uppermost sheet, to the feeder board 122. A recording medium 114 which has been conveyed to the feeder board 122 is supplied through a transfer drum 124*a* to a pressure drum (permeation suppression agent drum) 126*a* of the permeation suppression agent deposition unit 104.

Holding hooks (grippers) 115*a* and 115*b* for holding the leading edge of the recording medium 114 are fowled on the surface (circumferential surface) of the pressure drum 126*a*, and the recording medium 114 that has been transferred to the pressure drum 126*a* from the transfer drum 124*a* is conveyed in the direction of rotation (the counter-clockwise direction in FIG. 21) of the pressure drum 126*a* in a state where the leading edge is held by the holding hooks 115*a* and 115*b* and the medium adheres tightly to the surface of the pressure drum 126*a* (in other words, in a state where the medium is wrapped about the pressure drum 126*a*). A similar composition is also employed for the other pressure drums 126*b* to 126*d*, which are described hereinafter. A member 116 for transferring the leading edge of the leading edge of the recording medium 114 to the holding hooks 115*a* and 115*b* of the pressure drum 126*a* is formed on the surface (circumferential surface) of the transfer drum 124*a*. A similar composition is also employed for the other transfer drums 124*b* to 124*d*, which are described hereinafter.

<Permeation Suppression Agent Deposition Unit>

In the permeation suppression agent deposition unit 104, a paper preheating unit 128, a permeation suppression agent ejection head 130 and a permeation suppression agent drying unit 132 are provided respectively at positions opposing the surface of the pressure drum 126*a*, in this order from the upstream side in terms of the direction of rotation of the pressure drum 126*a* (the counter-clockwise direction in FIG. 21).

The paper preheating unit 128 and the permeation suppression agent drying unit 132 are provided with hot air driers which can control the temperature and air blowing volume within a prescribed range. When the recording medium 114 held on the pressure drum 126*a* passes the positions opposing the paper preheating unit 128 and the permeation suppression agent drying unit 132, hot air heated by the hot air driers is blown toward the surface of the recording medium 114.

The permeation suppression agent ejection head 130 ejects liquid containing a permeation suppression agent (the liquid also referred to simply as "permeation suppression agent") onto the recording medium 114 held on the pressure drum 126*a*. In the present embodiment, an ejection system is used as the device for depositing the permeation suppression agent on the surface of the recording medium 114, but the system is not limited to this, and it is also possible to use various other methods, such as a roller application system, a spray system, and the like.

The permeation suppression agent suppresses permeation of solvent (and organic solvent having affinity for the solvent) contained in the later-described treatment liquid and ink liquid into the recording medium 114. The permeation suppression agent is composed of resin particles dispersed as an emulsion in a solvent, or a resin dissolved in the solvent. Organic solvent or water is used as the solvent of the permeation suppression agent. Methyl ethyl ketone, petroleum, or the like may be desirably used as appropriate as the organic solvent of the permeation suppression agent.

The paper preheating unit 128 makes the temperature $T_1$ of the recording medium 114 higher than the lowest film formation temperature $T_n$ of the resin particles of the permeation suppression agent. Adjustment of the temperature $T_1$ may be carried out by the method of providing a heating element such as a heater or the like within the pressure drum 126*a* to heat the recording medium 114 from the bottom surface thereof, or the method of applying hot air to the upper surface of the recording medium 114, and the heating using an infrared heater to heat the recording medium 114 from the upper surface is used in the present embodiment. It is possible to use a combination of these.

If the recording medium 114 does not easily curl, the deposition of the permeation suppression agent may be omitted.

The treatment liquid deposition unit 106 is provided after the permeation suppression agent deposition unit 104. A transfer drum 124*b* is provided between the pressure drum (permeation suppression agent drum) 126*a* of the permeation suppression agent deposition unit 104 and a pressure drum (treatment liquid drum) 126*b* of the treatment liquid deposition unit 106, so as to make contact with same. By adopting this structure, after the recording medium 114 which is held on the pressure drum 126*a* of the permeation suppression agent deposition unit 104 has been subjected to the deposition of the permeation suppression agent, the recording medium 114 is transferred through the transfer drum 124*b* to the pressure drum 126*b* of the treatment liquid deposition unit 106.

<Treatment Liquid Deposition Unit>

In the treatment liquid deposition unit 106, a paper preheating unit 134, a treatment liquid ejection head 136 and a treatment liquid drying unit 138 are provided respectively at positions opposing the surface of the pressure drum 126*b*, in this order from the upstream side in terms of the direction of rotation of the pressure drum 126*b* (the counter-clockwise direction in FIG. 21).

The paper preheating unit 134 uses a similar composition to the paper preheating unit 128 of the permeation suppression agent deposition unit 104, and the explanation is omitted here. Of course, it is also possible to employ a different composition.

The treatment liquid ejection head 136 ejects the treatment liquid to the recording medium 114 held on the pressure drum 126*b*, and has a composition similar to ink ejection heads 140C, 140M, 140Y and 140K of the later described ink ejection unit 108. The treatment liquid used in the present embodiment is an acidic liquid that has the action of aggregating the coloring materials contained in the inks that are ejected onto the recording medium 114 respectively from the ink ejection heads 140C, 140M, 140Y and 140K disposed in the ink ejection unit 108, which is arranged at a downstream stage.

The treatment liquid drying unit 138 is provided with a hot air drier which can control the temperature and air blowing volume within a prescribed range. When the recording medium 114 held on the pressure drum 126*b* passes the position opposing the hot air drier of the treatment liquid drying unit 138, hot air heated by the hot air driers is blown toward the treatment liquid on the recording medium 114.

The heating temperature of the hot air drier is set to a temperature at which the treatment liquid which has been deposited on the recording medium 114 by the treatment liquid ejection head 136 disposed to the upstream side in terms of the direction of rotation of the pressure drum 126*b* is dried, and a solid or semi-solid aggregating treatment agent layer (a thin film layer of dried treatment liquid) is formed on the recording medium 114.

Reference here to "aggregating treatment agent layer in a solid state or a semi-solid state" includes a layer having a moisture content ratio of 0% to 70% as defined below. "Moisture content ratio"="Weight per unit surface area of water contained in treatment liquid after drying ($g/m^2$)"/"Weight per unit surface area of treatment liquid after drying ($g/m^2$)"

Also, "aggregating treatment agent" refers not only to a solid or semi-solid substance, but in addition is used in the broader concept to include a liquid substance. In particular, liquid aggregating treatment agent that includes 70% or more solvent (content rate of solvent) is referred to as "aggregating treatment liquid".

The method of calculating the solvent content of the aggregating treatment agent is to cut out a specific size of sheet (for example 100 mm×100 mm), and to measure the total weight after applying treatment liquid (sheet+treatment liquid before drying) and the total weight after drying the treatment liquid (sheet+treatment liquid after drying). From the difference of these measurements, the amount of reduction in solvent due to drying (quantity of solvent evaporated) is obtained. Also, the calculated quantity obtained from the method of adjusting the treatment liquid may be used as the quantity of solvent contained in the treatment liquid before drying. From these calculation results, the solvent content can be obtained.

Here, the following Table 1 shows the results of evaluation of the movement of color material when the solvent content rate of the treatment liquid (aggregation treatment agent layer) on the recording medium 114 is changed.

TABLE 1

| | Experiment 1 | Experiment 2 | Experiment 3 | Experiment 4 | Experiment 5 |
|---|---|---|---|---|---|
| Drying process | No | Yes | Yes | Yes | Yes |
| Total weight ($g/m^2$) | 10.0 | 6.0 | 4.0 | 3.0 | 1.3 |
| Weight of water ($g/m^2$) | 8.7 | 4.7 | 2.7 | 1.5 | 0 |
| Content rate of solvent (%) | 87 | 78 | 67 | 50 | 0 |
| Movement of coloring material | Poor (Failure) | Average (Dot moves slightly) | Good (Inconspicuous though dot moves) | Excellent | Excellent |

As illustrated in Table 1, if the treatment liquid was not dried (Experiment 1), image degradation due to movement of color material occurred.

In contrast, in cases where the treatment liquid was dried (Experiments 2 to 5), when the treatment liquid was dried until the solvent content in the treatment liquid became 70% or less, movement of color material was not conspicuous. Further, when the treatment liquid was dried until the solvent content in the treatment liquid became 50% or less, the level was so good that movement of color material could not be detected visually. Therefore it has been confirmed that this is effective in preventing image degradation.

In this way, by drying the treatment liquid on the recording medium 114 to a solvent content of 70% or less (desirably 50% or less) so that a solid or semi-solid layer of aggregation treatment agent is formed on the recording medium 114, it is possible to prevent image degradation due to movement of color material.

A desirable mode is one in which the recording medium 114 is preheated by the heater of the paper preheating unit 134, before depositing treatment liquid on the recording medium 114, as in the present embodiment. In this case, it is possible to restrict the heating energy required to dry the treatment liquid to a low level, and therefore energy savings can be made.

<Ink Ejection Unit>

The ink ejection unit 108 is provided after the treatment liquid deposition unit 106. A transfer drum 124*c* is provided between the pressure drum (treatment liquid drum) 126*b* of the treatment liquid deposition unit 106 and a pressure drum 126*c* (corresponding to the relative movement device) of the ink ejection unit 108, so as to make contact with same. By means of this structure, the treatment liquid is deposited onto the recording medium 114 held on the pressure drum 126*b* of the treatment liquid deposition unit 106, thereby forming a solid or semi-solid layer of aggregating treatment agent, whereupon the recording medium 114 is transferred through the transfer drum 124*c* to the pressure drum 126*c* of the ink ejection unit 108.

In the ink ejection unit 108, the ink ejection heads 140C, 140M, 140Y and 140K which correspond respectively to four colors of ink, C (cyan), M (magenta), Y (yellow) and K (black), and solvent drying units 142*a* and 142*b* are provided respectively at positions opposing the surface of the pressure drum 126*c*, in this order from the upstream side in terms of the direction of rotation of the pressure drum 126*c* (the counter-clockwise direction in FIG. 21).

The ink ejection heads 140C, 140M, 140Y and 140K employ liquid ejection type recording heads (liquid ejection heads), similarly to the above-described treatment liquid ejection head 136. In other words, the ink ejection heads 140C, 140M, 140Y and 140K respectively eject droplets of corresponding colored inks onto the recording medium 114 held on the pressure drum 126*c*.

In the present embodiment, the elongated line head 80 (hereinafter also referred to simply as "head 80") as shown in FIG. 20 formed by connecting the head modules 10 in FIG. 1 is used as each of the ink ejection heads 140C, 140M, 140Y and 140K.

An ink storing and loading unit (not shown) has ink tanks for storing the inks to be supplied to the ink ejection heads 140C, 140M, 140Y and 140K, respectively. The tanks are connected to the corresponding ink ejection heads by means of prescribed channels, and supply the inks to the corresponding ink ejection heads. The ink storing and loading unit has a warning device (for example, a display device or an alarm sound generator) for warning when the remaining amount of any ink in the tank is low, and has a mechanism for preventing loading errors among the colors.

The inks are supplied from the ink tanks of the ink storing and loading unit to the ink ejection heads 140C, 140M, 140Y and 140K, and droplets of the colored inks are ejected from the ink ejection heads 140C, 140M, 140Y and 140K in accordance with the image signal toward the recording medium 114.

Each of the ink ejection heads 140C, 140M, 140Y and 140K is the full-line type head (see FIG. 20) which has a length corresponding to a maximum width of an image forming region of the recording medium 114 held on the pressure drum 126*c*, and has the plurality of nozzles for ejecting ink (not shown in FIG. 21) arrayed on the ink ejection surface thereof over the full width of the image forming region of the recording medium 114. The ink ejection heads 140C, 140M, 140Y and 140K are fixed so as to extend in a direction that is perpendicular to the direction of rotation of the pressure drum 126*c* (the conveyance direction of the recording medium 114).

According to the composition in which such full line heads having the nozzle rows which cover the full width of the image forming region of the recording medium 114 are provided for the respective colors of ink, it is possible to record an image on the image forming region of the recording medium 114 by performing just one operation of moving the recording medium 114 and the ink ejection heads 140C, 140M, 140Y and 140K relatively to each other (in other words, by one sub-scanning action) in the conveyance direction (the sub-scanning direction) by conveying the recording medium 114 in a fixed speed by the pressure drum 126*c*. Therefore, it is possible to achieve a higher printing speed compared to a case which uses a serial (shuttle) type of head which moves back and forth reciprocally in the direction (the main scanning direction) perpendicular to the conveyance direction of the recording medium 114 (sub-scanning direction), and hence it is possible to improve the print productivity.

The inkjet recording apparatus 100 according to the present embodiment is able to record on recording media (recording paper) up to a maximum size of 720 mm×520 mm and hence a drum having a diameter of 810 mm corresponding to the recording medium width of 720 mm is used for the pressure drum (print drum) 126*c*. The ink ejection volume of the ink ejection heads 140C, 140M, 140Y and 140K is 2 pl, for example, and the recording density is 1200 dpi in both the main scanning direction (the widthwise direction of the recording medium 114) and the sub-scanning direction (the conveyance direction of the recording medium 114).

Although the configuration with the CMYK four colors is described in the present embodiment, combinations of the ink colors and the number of colors are not limited to those. Light inks, dark inks or special color inks can be added or removed as required. For example, a configuration in which ink heads for ejecting light-colored inks such as light cyan and light magenta are added, or a configuration using the CMYK four colors is possible. Furthermore, there are no particular restrictions of the sequence in which the heads of respective colors are arranged.

Each of the solvent drying units 142*a* and 142*b* has a composition including a hot air drier which can control the temperature and air blowing volume within a prescribed range, similarly to the paper preheating units 128 and 134, the permeation suppression agent drying unit 132, and the treatment liquid drying unit 138, which are described above. As described hereinafter, if ink droplets are ejected onto the layer of aggregating treatment agent in a solid state or semi-solid state which has been formed on the recording medium 114, an ink aggregate (coloring material aggregate) is formed on the recording medium 114, and furthermore, the ink solvent which has separated from the coloring material spreads and a liquid layer of dissolved aggregating treatment agent is formed. The solvent component (liquid component) left on the recording medium 114 in this way is a cause of curling of the recording medium 114 and also leads to deterioration of the image. Therefore, in the present embodiment, after ejecting droplets of the corresponding colored inks onto the recording medium 114 respectively from the ink ejection heads 140C, 140M, 140Y and 140K, the solvent component is evaporated off and dried by the hot air driers of the solvent drying units 142*a* and 142*b*.

The fixing unit 110 is provided subsequent to the ink ejection unit 108, and a transfer drum 124*d* is provided between the pressure drum (image rendering drum) 126*c* of the ink ejection unit 108 and a pressure drum (fixing drum) 126*d* of the fixing unit 110 so as to make contact with the pressure drums. By this means, after the respective colored inks have been deposited on the recording medium 114 which is held on the pressure drum 126*c* of the ink ejection unit 108, the recording medium 114 is transferred through the transfer drum 124*d* to the pressure drum 126*d* of the fixing unit 110.

<Fixing Unit>

The fixing unit 110 is provided with a print determination unit 144, which reads in the print results of the ink ejection unit 108, and heating rollers 148*a* and 148*b* at positions opposing the surface of the pressure drum 126*d*, in this order from the upstream side in terms of the direction of rotation of the pressure drum 126*d* (the counter-clockwise direction in FIG. 21).

The print determination unit 144 includes an image sensor (a line sensor, or the like), which captures an image of the print result of the ink ejection unit 108 (the ink droplet deposition results of the ink ejection heads 140C, 140M, 140Y and 140K), and functions as a device for checking for nozzle blockages and other ejection defects, on the basis of the droplet ejection image captured through the image sensor.

Each of the heating rollers 148*a* and 148*b* is a roller of which temperature can be controlled in a prescribed range (e.g., 100° C. to 180° C.). The image formed on the recording medium 114 is fixed while nipping the recording medium 114 between the heating roller 148*a* or 148*b* and the pressure drum 126*d* to heat and press the recording medium 114. It is desirable that the heating temperature of the heating rollers 148*a* and 148*b* is set in accordance with the glass transition temperature of the polymer particles contained in the treatment liquid or the ink, for example.

The paper output unit 112 is arranged after the fixing unit 110. The paper output unit 112 is provided with a paper output drum 150, which receives the recording medium 114 on which the image has been fixed, a paper output platform 152, on which the recording media 114 are stacked, and a paper output chain 154 having a plurality of paper output grippers, which is spanned between a sprocket arranged on the paper output drum 150 and a sprocket arranged above the paper output platform 152.

<Description of Control System>

Figure 22:
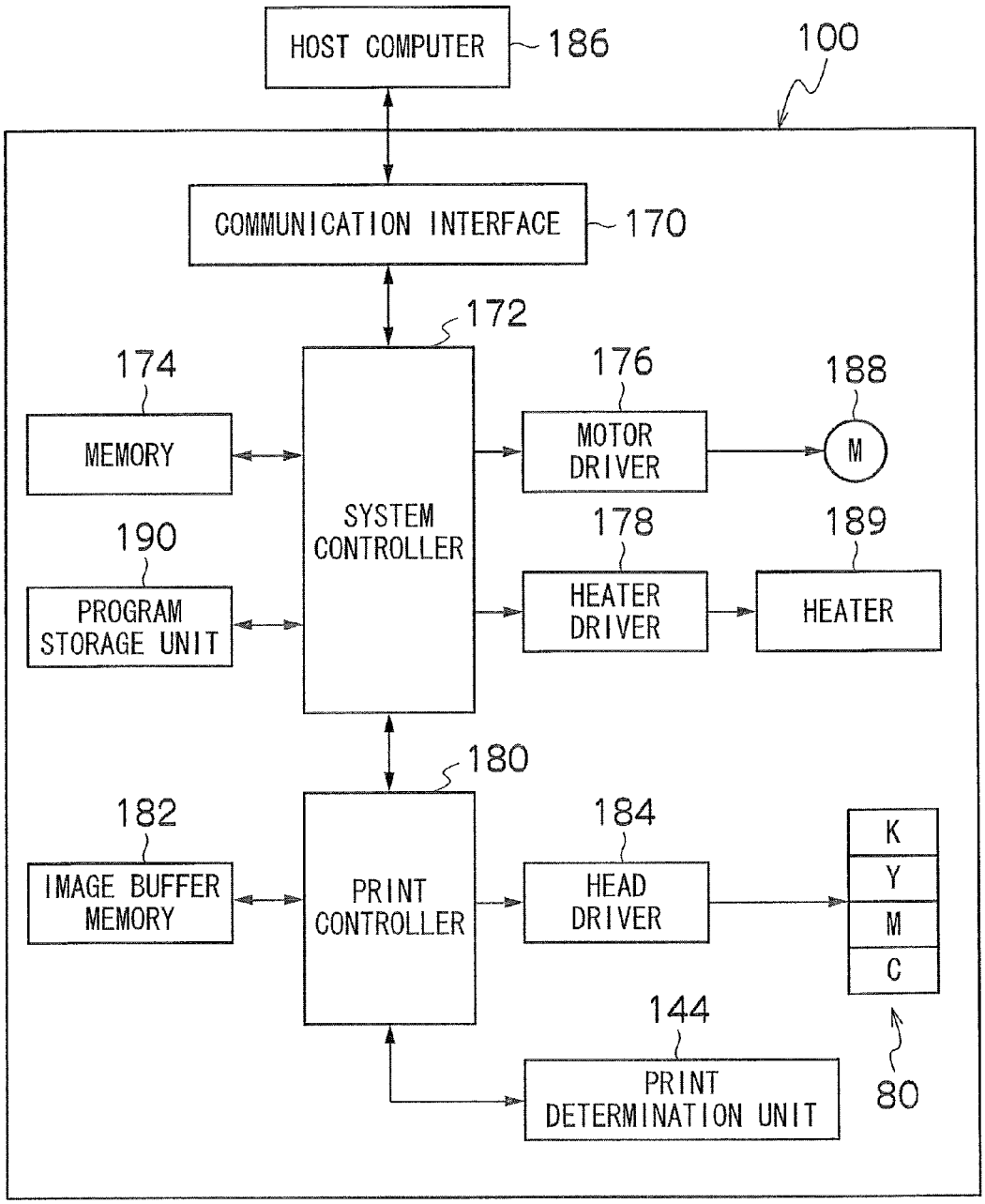
FIG. 22 is a main part block diagram showing a system configuration of the inkjet recording device shown in FIG. 1.

FIG. 22 is a principal block diagram illustrating the system configuration of the inkjet recording apparatus 100. The inkjet recording apparatus 100 includes a communication interface 170, a system controller 172, a memory 174, a motor driver 176, a heater driver 178, a print controller 180, an image buffer memory 182, a head driver 184, and the like.

The communication interface 170 is an interface unit for receiving image data sent from a host computer 186. A serial interface such as USB (Universal Serial Bus), IEEE1394, Ethernet, wireless network, or a parallel interface such as a Centronics interface may be used as the communication interface 170. A buffer memory (not shown) may be mounted in this portion in order to increase the communication speed. The image data sent from the host computer 186 is received by the inkjet recording apparatus 100 through the communication interface 170, and is temporarily stored in the memory 174.

The memory 174 is a storage device for temporarily storing image data inputted through the communication interface 170, and data is written and read to and from the memory 174 through the system controller 172. The memory 174 is not limited to a memory composed of semiconductor elements, and a hard disk drive or another magnetic medium may be used.

The system controller 172 is constituted of a central processing unit (CPU) and peripheral circuits thereof, and the like, and it functions as a control device for controlling the whole of the inkjet recording apparatus 100 in accordance with a prescribed program, as well as a calculation device for performing various calculations. More specifically, the system controller 172 controls the various sections, such as the communication interface 170, memory 174, motor driver 176, heater driver 178, and the like, as well as controlling communications with the host computer 186 and writing and reading to and from the memory 174, and it also generates control signals for controlling the motor 188 and heater 189 of the conveyance system.

The program executed by the CPU of the system controller 172 and the various types of data which are required for control procedures are stored in the memory 174. The memory 174 may be a non-rewriteable storage device, or it may be a rewriteable storage device, such as an EEPROM. The memory 174 is used as a temporary storage region for the image data, and it is also used as a program development region and a calculation work region for the CPU.

Various control programs are stored in the program storage unit 190, and a control program is read out and executed in accordance with commands from the system controller 172. The program storage unit 190 may use a semiconductor memory, such as a ROM, EEPROM, or a magnetic disk, or the like. An external interface may be provided, and a memory card or PC card may also be used. Naturally, a plurality of these recording media may also be provided. The program storage unit 190 may also be combined with a storage device for storing operational parameters, and the like (not shown).

The motor driver 176 is a driver that drives the motor 188 in accordance with instructions from the system controller 172. In FIG. 22, the plurality of motors (actuators) disposed in the respective sections of the inkjet recording apparatus 100 are represented by the reference numeral 188. For example, the motor 188 shown in FIG. 22 includes the motors that drive the pressure drums 126*a* to 126*d*, the transfer drums 124*a* to 124*d* and the paper output drum 150, shown in FIG. 21.

The heater driver 178 is a driver that drives the heater 189 in accordance with instructions from the system controller 172. In FIG. 22, the plurality of heaters disposed in the inkjet recording apparatus 100 are represented by the reference numeral 189. For example, the heater 189 shown in FIG. 22 includes the heaters of the paper preheating units 128 and 134, the permeation suppression agent drying unit 132, the treatment liquid drying unit 138, the solvent drying unit 142*a* and 142*b*, the heating rollers 148*a* and 148*b*, shown in FIG. 21.

The print controller 180 is a control unit that has signal processing functions for carrying out processing, correction, and other treatments in order to generate a print control signal on the basis of the image data in the memory 174 in accordance with the control of the system controller 172. The print controller 180 supplies the print data (dot data) thus generated to the head driver 184. Prescribed signal processing is carried out in the print controller 180, and the ejection volume and the ejection timing of the ink droplets in the head 80 (representing the ink ejection heads 140C, 140M, 140Y and 140K shown in FIG. 21) are controlled through the head driver 184 on the basis of the image data. By this means, prescribed dot size and dot positions can be achieved.

The print controller 180 is provided with the image buffer memory 182, and image data, parameters, and other data are temporarily stored in the image buffer memory 182 when image data is processed in the print controller 180. Also possible is an aspect in which the print controller 180 and the system controller 172 are integrated to form a single processor.

To give a general description of the sequence of processing from image input to print output, image data to be printed is inputted from an external source through the communication interface 170, and is accumulated in the image memory 174. At this stage, multiple-value RGB image data is stored in the image memory 174, for example.

The original image data (RGB data) stored in the image memory 174 is sent to the print controller 180 through the system controller 172, and is converted to the dot data (binary data or multiple-value data including the information of the dot size) for each ink color (K, C, M, Y) by a half-toning technique, using dithering, error diffusion, or the like, in the print controller 180.

The dot data thus generated by the print controller 180 is stored in the image buffer memory 182. This dot data of the respective colors is converted into CMYK droplet ejection data for ejecting ink from the nozzles of the head 80, thereby establishing the ink ejection data to be printed.

The head driver 184 outputs drive signals for driving the piezoelectric elements (the actuator 38 in FIG. 3) corresponding to the nozzles 14 of the head 80, on the basis the print data supplied by the print controller 180 (i.e., the dot data stored in the image buffer memory 182). A feedback control system for maintaining constant drive conditions in the head may be included in the head driver 184. The head driver 184 in FIG. 22 represents the individual drive circuits corresponding to the driving boards 18A and 18B described with reference to FIG. 1 and the driving boards 19A to 19D described with reference to FIG. 7.

The inkjet recording apparatus 100 uses the piezoelectric driving system in which the common driving waveform signal is applied to the piezoelectric elements corresponding to the nozzles belonging to the same nozzle group block of the M division, to change the on and off of the switching elements connected to the individual electrodes of the piezoelectric elements in accordance with the ejection timings of the piezoelectric elements (the actuators 38) so that droplets of the ink are ejected from the nozzles corresponding to the piezoelectric elements.

The print determination unit 144 is a block that includes the CCD line sensor as described above with reference to FIG. 21, reads the image printed on the recording medium 114, determines the print conditions (color, concentration, presence of the ejection, variation in the droplet deposition, and the like) by performing desired signal processing, or the like, and provides the determination results of the print conditions to the print controller 180 through the system controller 172.

The print controller 180 determines an abnormal ejection nozzle on the basis of the information obtained from the print determination unit 144. If it is possible to compensate for the abnormal ejection nozzle by image correction, the print controller 180 outputs the control signals through the system controller 172 to the concerning parts to perform the image correction, and if it is not possible by image correction, the print controller 180 outputs the control signals through the system controller 172 to the concerning parts to perform nozzle restoring operations, such as preliminary ejection, or suctioning, to the abnormal ejection nozzle.

<Printing Operation by Inkjet Recording Apparatus>

Next, actions of the inkjet recording apparatus 100 having the above-described structure are described.

The recording medium 114 is conveyed to the feeder board 122 from the paper supply platform 120 of the paper supply unit 102. The recording medium 114 is held on the pressure drum 126*a* of the permeation suppression agent deposition unit 104 through the transfer drum 124*a*, and is preheated by the paper preheating unit 128, and droplets of the permeation suppression agent are deposited by the permeation suppression agent ejection head 130. Thereupon, the recording medium 114 which is held on the pressure drum 126*a* is heated by the permeation suppression agent drying unit 132, and the solvent component (liquid component) of the permeation suppression agent is evaporated and dried.

The recording medium 114 which has been subjected to permeation suppression processing in this way is transferred from the pressure drum 126*a* of the permeation suppression agent deposition unit 104 through the transfer drum 124*b* to the pressure drum 126*b* of the treatment liquid deposition unit 106. The recording medium 114 which is held on the pressure drum 126*b* is preheated by the paper preheating unit 134 and droplets of the treatment liquid are deposited by the treatment liquid ejection head 136. Thereupon, the recording medium 114 which is held on the pressure drum 126*b* is heated by the treatment liquid drying unit 138, and the solvent component (liquid component) of the treatment liquid is evaporated and dried. By this means, a layer of aggregating treatment agent in a solid state or semi-solid state is formed on the recording medium 114.

The recording medium 114 on which the solid or semi-solid layer of aggregating treatment agent has been formed is transferred from the pressure drum 126*b* of the treatment liquid deposition unit 106 though the transfer drum 124*c* to the pressure drum 126*c* of the ink ejection unit 108. Droplets of corresponding colored inks are deposited respectively from the ink ejection heads 140C, 140M, 140Y and 140K onto the recording medium 114 held on the pressure drum 126*c*, in accordance with the input image data.

When the ink droplets are deposited onto the aggregating treatment agent layer, then the contact surface between the ink droplets and the aggregating treatment agent layer is a prescribed surface area when the ink lands, due to a balance between the propulsion energy and the surface energy. An aggregating reaction starts immediately after the ink droplets land on the aggregating treatment agent, but the aggregating reaction starts from the contact surface between the ink droplets and the aggregating treatment agent layer. Since the aggregating reaction occurs only in the vicinity of the contact surface, and the coloring material in the ink aggregates while receiving an adhesive force in the prescribed contact surface area upon landing of the ink, then movement of the coloring material is suppressed.

Even if another ink droplet is deposited adjacently to this ink droplet, since the coloring material of the previously deposited ink have already aggregated, then the coloring material does not mix with the subsequently deposited ink, and therefore bleeding is suppressed. After aggregation of the coloring material, the separated ink solvent spreads, and a liquid layer containing dissolved aggregating treatment agent is formed on the recording medium 114.

Thereupon, the recording medium 114 held on the pressure drum 126*c* is heated by the solvent drying units 142*a* and 142*b*, and the solvent component (liquid component) which has been separated from the ink aggregate on the recording medium 114 is evaporated off and dried. As a result, curling of the recording medium 114 is prevented, and furthermore deterioration of the image quality as a result of the presence of the solvent component can be restricted.

The recording medium 114 onto which the colored inks have been deposited by the ink ejection unit 108 is transferred from the pressure drum 126*c* of the ink ejection unit 108 through the transfer drum 124*d* to the pressure drum 126*d* of the fixing unit 110. After the printing results achieved by the ink ejection unit 108 are read out by the print determination unit 144 from the recording medium 114 held on the pressure drum 126*d*, then heating and pressure processing are carried out by the heating rollers 148*a* and 148*b*.

When the recording medium 114 is further transferred from the pressure drum 126*d* to the paper output drum 150, it is conveyed to the paper output platform 152 by the paper output chain 154. The recording medium 114 on which an image has been formed in this way is then conveyed onto the paper output platform 152 by the paper output chain 154 and is stacked on the paper output platform 152.

Examples of Permeation Suppression Agent, Treatment Liquid, and Ink

Examples of the permeation suppression agent, the treatment liquid and the ink used in the present embodiment are described below.

<Permeation Suppression Agent>

A mixed solution was prepared by mixing 10 g of a dispersion stabilizer resin (Q-1) having the following structure:

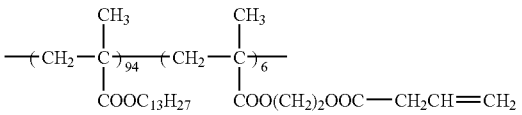

Mw = $4 \times 10^4$ (weight composition ratio), 100 g of vinyl acetate and 384 g of Isopar H (made by Exxon), and was heated to a temperature of 70° C. while being agitated in a nitrogen gas flow. Then, 0.8 g of 2,2'-azobis(isovaleronitrile) (A.I.V.N.) was added as a polymerization initiator, and the mixture was made react for 3 hours. 20 minutes after adding the polymerization initiator, white turbidity was produced and the reaction temperature rose to 88° C. A further 0.5 g of polymerization initiator was added and after making reaction for 2 hours, the temperature was raised to 100° C. and the mixture was agitated for 2 hours. Then, vinyl acetate that had not reacted was removed. The mixture was cooled and then passed through a 200-mesh nylon cloth. The white dispersed material thereby obtained was a latex having a polymerization rate of 90%, an average particle size of 0.23 μm and good monodisperse properties. The particle size was measured with a Horiba CAPA-500.

A portion of the white dispersed material was placed in a centrifuge (for example, rotational speed: $1\times10^4$ r.p.m.; operating duration: 60 minutes), and the precipitated resin particles were complemented and dried. The weight-average molecular weight (Mw), glass transition point (Tg) and minimum film forming temperature (MFT) of the resin particles were measured as follows: Mw was $2\times10^5$ (GPC value converted to value for polystyrene), Tg was 38° C. and MFT was 28° C.

The permeation suppression agent liquid prepared as described above was deposited onto the recording paper. During deposition, the recording paper was heated by the drum, and after the deposition, the Isopar H was evaporated off by blowing a hot air flow.

<Ink>

The ink used in the present embodiment is aqueous pigment ink that contains the following materials insoluble to the solvent (water): pigment particles as the coloring material, and polymer particles.

It is desirable that the concentration of the solvent-insoluble materials in the ink is not less than 1 wt % and not more than 20 wt %, taking account of the fact that the viscosity of the ink suitable for ejection is 20 mPa·s or lower. It is more desirable that the concentration of the pigment in the ink is not less than 4 wt %, in order to obtain good optical density in the image. It is desirable that the surface tension of the ink is not less than 20 mN/m and not more than 40 mN/m, taking account of ejection stability in the ink ejection head.

The coloring material in the ink may be pigment or a combination of pigment and dye. From the viewpoint of the aggregating characteristics when the ink comes into contact with the treatment liquid, a dispersed pigment in the ink is desirable for more effective aggregation. Desirable pigments include: a pigment dispersed by a dispersant, a self-dispersing pigment, a pigment in which the pigment particle is coated with a resin (hereinafter referred to as "microcapsule pigment"), and a polymer grafted pigment. Moreover, from the viewpoint of the aggregating characteristics of the coloring material, it is more desirable that the coloring material is modified with a carboxyl group having a low degree of disassociation.

There are no particular restrictions on the resin used for a microcapsule pigment, but desirably, it should be a compound of high molecular weight which has a self-dispersing capability or solubility in water, and contains an anionic group (acidic). Generally, it is desirable that the resin should have a number average molecular weight in the approximate range of 1,000 to 100,000, and especially desirably, in the approximate range of 3,000 to 50,000. Moreover, desirably, this resin can dissolved in an organic solvent to form a solution. By limiting the number average molecular weight of the resin to this range, it is possible to make the resin display satisfactory functions as a covering film for the pigment particle, or as a coating film in the ink composition.

The resin may itself have a self-dispersing capability or solubility, or these functions may be added or introduced. For example, it is possible to use a resin having an introduced carboxyl group, sulfonic acid group, or phosphoric acid group or another anionic group, by neutralizing with an organic amine or alkali metal. Moreover, it is also possible to use a resin into which one or two or more anionic groups of the same type or different types have been introduced. In the present embodiment, it is desirable to use a resin which has been neutralized by means of a salt and which contains an introduced carboxyl group.

It is desirable in the present embodiment that the colored ink liquid contains polymer particles that do not contain any colorant, as a component for reacting with the treatment liquid. The polymer particles can improve the image quality by strengthening the ink viscosity raising action and the aggregating action through reaction with the treatment liquid. In particular, a highly stable ink can be obtained by adding anionic polymer particles to the ink.

By using the ink containing the polymer particles that produce the viscosity raising action and the aggregating action through reaction with the treatment liquid, it is possible to increase the quality of the image, and at the same time, depending on the type of polymer particles, the polymer particles may form a film on the recording medium, and therefore beneficial effects can be obtained in improving the wear resistance and the waterproofing characteristics of the image.

The method of dispersing the polymer particles in the ink is not limited to adding an emulsion of the polymer particles to the ink, and the resin may also be dissolved, or included in the form of a colloidal dispersion, in the ink.

The polymer particles may be dispersed by using an emulsifier, or the polymer particles may be dispersed without using any emulsifier. For the emulsifier, a surface active agent of low molecular weight is generally used, and it is also possible to use a surface active agent of high molecular weight. It is also desirable to use a capsule type of polymer particles having an outer shell composed of acrylic acid, methacrylic acid, or the like (core-shell type of polymer particles in which the composition is different between the core portion and the outer shell portion).

The polymer particles dispersed without any surface active agent of low molecular weight are known as the soap-free latex, which includes polymer particles with no emulsifier or a surface active agent of high molecular weight. For example, the soap-free latex includes polymer particles that use, as an emulsifier, the above-described polymer having a water-soluble group, such as a sulfonic acid group or carboxylic acid group (a polymer with a grafted water-soluble group, or a block polymer obtained from a monomer having a water-soluble group and a monomer having an insoluble part).

It is especially desirable in the present embodiment to use the soap-free latex compared to other type of resin particles obtained by polymerization using an emulsifier, since there is no possibility that the emulsifier inhibits the aggregating reaction and film formation of the polymer particles, or that the free emulsifier moves to the surface after film formation of the polymer particles and thereby degrades the adhesive properties between the recording medium and the ink aggregate in which the coloring material and the polymer particles are combined.

Examples of the resin component added as the resin particles to the ink include: an acrylic resin, a vinyl acetate resin, a styrene-butadiene resin, a vinyl chloride resin, an acrylstyrene resin, a butadiene resin, and a styrene resin.

In order to make the polymer particles have high speed aggregation characteristics, it is desirable that the polymer particles contain a carboxylic acid group having a low degree of disassociation. Since the carboxylic acid group is readily affected by change of pH, then the polymer particles containing the carboxylic acid group easily change the state of the dispersion and have high aggregation characteristics.

The change in the dispersion state of the polymer particles caused by change in the pH can be adjusted by means of the component ratio of the polymer particle having a carboxylic acid group, such as ester acrylate, or the like, and it can also be adjusted by means of an anionic surfactant which is used as a dispersant.

Desirably, the resin constituting the polymer particles is a polymer that has both of a hydrophilic part and a hydrophobic part. By incorporating a hydrophobic part, the hydrophobic part is oriented toward to the inner side of the polymer particle, and the hydrophilic part is oriented efficiently toward the outer side, thereby having the effect of further increasing the change in the dispersion state caused by change in the pH of the liquid. Therefore, aggregation can be performed more efficiently.

The weight ratio of the polymer particles to the pigment is desirably 2:1 through 1:10, and more desirably 1:1 through 1:3. If the weight ratio of the polymer particles to the pigment is less than 2:1, then there is no substantial improvement in the aggregating force of the aggregate formed by the cohesion of the polymer particles. On the other hand, if the weight ratio of the polymer particles to the pigment is greater than 1:10, the viscosity of the ink becomes too high and the ejection characteristics, and the like, deteriorate.

From the viewpoint of the adhesive force after the cohesion, it is desirable that the molecular weight of the polymer particles added to the ink is no less than 5,000. If it is less than 5,000, then beneficial effects are insufficient in terms of improving the internal aggregating force of the ink aggregate, achieving good fixing characteristics after transfer to the recording medium, and improving the image quality.

Desirably, the volume-average particle size of the polymer particles is in the range of 10 nm to 1 μm, more desirably, the range of 10 nm to 500 nm, even desirably 20 nm to 200 nm and particularly desirably, the range of 50 nm to 200 nm. If the particle size is equal to or less than 10 nm, then significant effects in improving the image quality or enhancing transfer characteristics cannot be expected, even if aggregation occurs. If the particle size is equal to or greater than 1 μm, then there is a possibility that the ejection characteristics from the ink head or the storage stability will deteriorate. Furthermore, there are no particular restrictions on the volume-average particle size distribution of the polymer particles and they may have a broad volume-average particle size distribution or they may have a monodisperse volume-average particle size distribution.

Moreover, two or more types of polymer particles may be used in combination in the ink.

Examples of the pH adjuster added to the ink in the present embodiment include an organic base and an inorganic alkali base, as a neutralizing agent. In order to improve storage stability of the ink for inkjet recording, the pH adjuster is desirably added in such a manner that the ink for inkjet recording has the pH of 6 through 10.

It is desirable in the present embodiment that the ink contains a water-soluble organic solvent, from the viewpoint of preventing nozzle blockages in the ejection head due to drying. Examples of the water-soluble organic solvent include a wetting agent and a penetrating agent.

Examples of the water-soluble organic solvent in the ink are: polyhydric alcohols, polyhydric alcohol derivatives, nitrous solvents, monohydric alcohols, and sulfurous solvents.

The ink used in the present embodiment may contain a surfactant. It is desirable in the present embodiment that the ink has the surface tension of 10 mN/m to 50 mN/m. Moreover, from the viewpoint of simultaneously achieving good wetting properties on an intermediate transfer medium when recording by an intermediate transfer method, as well as finer size of the liquid droplets and good ejection characteristics, it is more desirable that the ink has the surface tension of 15 mN/m to 45 mN/m.

It is desirable in the present embodiment that the ink has the viscosity of 1.0 mPa·s to 20.0 mPa·s.

Apart from the foregoing, according to requirements, it is also possible that the ink contains a pH buffering agent, an anti-oxidation agent, an antibacterial agent, a viscosity adjusting agent, a conductive agent, an ultraviolet absorbing agent, or the like.

<Treatment Liquid>

It is desirable in the present embodiment that the treatment liquid (aggregating treatment liquid) has effects of generating aggregation of the pigment and the polymer particles contained in the ink by producing a pH change in the ink when coming into contact with the ink.

Specific examples of the contents of the treatment liquid are: polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, derivatives of these compounds, and salts of these.

A treatment liquid having added thereto a polyvalent metal salt or a polyallylamine is the preferred examples of the treatment liquid. The aforementioned compounds may be used individually or in combinations of two or more thereof.

From the standpoint of aggregation ability with the ink, the treatment liquid preferably has a pH of 1 to 6, more preferably a pH of 2 to 5, and even more preferably a pH of 3 to 5.

The amount of the component that causes aggregation of the pigment and polymer particles of the ink in the treatment liquid is preferably not less than 0.01 wt % and not more than 20 wt % based on the total weight of the liquid. Where the amount of this component is less than 0.01 wt %, sufficient concentration diffusion does not proceed when the treatment liquid and ink come into contact with each other, and sufficient aggregation action caused by pH variation sometimes does not occur. Further, where the amount of this component is more than 20 wt %, the ejection ability from the inkjet head can be degraded.

From the standpoint of preventing the nozzles of inkjet heads from being clogged by the dried treatment liquid, it is preferred that the treatment liquid include an organic solvent capable of dissolving water and other additives. A wetting agent and a penetrating agent are included in the organic solvent capable of dissolving water and other additives.

The solvents can be used individually or in a mixture of plurality thereof together with water and other additives.

The content ratio of the organic solvent capable of dissolving water and other additives is preferably not more than 60 wt % based on the total weight of the treatment liquid. Where this amount is higher than 60 wt %, the viscosity of the treatment liquid increases and ejection ability from the inkjet head can be degraded.

In order to improve fixing ability and abrasive resistance, the treatment liquid may further include a resin component. Any resin component may be employed, provided that the ejection ability from a head is not degraded when the treatment liquid is ejected by an inkjet system and also provided that the treatment liquid will have high stability in storage. Thus, water-soluble resins and resin emulsions can be freely used.

The aggregation ability may be further improved by introducing polymer microparticles of reverse polarity with respect to that of the ink into the treatment liquid and causing the aggregation of the pigment contained in the ink with the polymer microparticles.

The aggregation ability may be also improved by introducing a curing agent corresponding to the polymer microparticle component contained in the ink into the treatment liquid, bringing the two liquids into contact, causing aggregation and also crosslinking or polymerization of the resin emulsion in the ink component.

The treatment liquid used in the present embodiment may contain a surfactant.

It is desirable in the present embodiment that the treatment liquid has the surface tension of 10 mN/m to 50 mN/m. From the standpoint of improving the wettability on the intermediate transfer body and also size reduction ability and ejection ability of droplets, it is even more preferred that the surface tension be 15 mN/m to 45 mN/m.

It is desirable in the present embodiment that the treatment liquid has the viscosity of 1.0 mPa·s to 20.0 mPa·s.

Apart from the foregoing, according to requirements, it is also possible that the ink contains a pH buffering agent, an anti-oxidation agent, an antibacterial agent, a viscosity adjusting agent, a conductive agent, an ultraviolet absorbing agent, or the like.

Modification of the Embodiment

The present embodiment above has illustrated the drum conveying system as the device which conveys a recording medium, but a belt conveying system, pallet conveying system or other system can be applied to the device which conveys a recording medium.

The embodiment above has described the inkjet recording device that forms an image by directly depositing ink droplets onto a recording medium (direct recording system), but the applicable scope of the present invention is not limited to this device, and the present invention can be applied to an intermediate transfer type image forming apparatus that forms an image (primary image) on an intermediate transfer body, transfers the image to a recording paper by means of a transfer part, and thereby finally forms an image. In this case, the intermediate transfer body to which the primary image is recorded can be interpreted as "image-rendering medium."

Moreover, the embodiment above has described the inkjet recording device that uses a full-line type head of page width having a nozzle line that is as long as the length of the entire width of a recording medium (a single-path system image forming apparatus that completes an image in a single sub-scanning). However, the applicable scope of the present invention is not limited this device, and the present invention can be applied to an inkjet recording device that records an image by scanning a recording medium several times while moving a serial-type (shuttle scanning type) head or other short recording head.

Furthermore, the term "image forming apparatus" incorporates not only the devices applied to so-called graphic printing, such as photographic printing and poster printing, but also the devices industrially applied to a device capable of forming a pattern that can be understood as an image, such as a resist printing device, a wire rendering device for an electronic circuit board, a fine structure forming device, and the like.

As is understood from the embodiments of the present invention described previously, the present specification includes disclosure of various technical ideas including the inventions described hereinafter.

In an aspect of the present invention, a droplet ejection apparatus includes: a droplet ejection head which has a plurality of nozzles arrayed two-dimensionally, droplets of liquid being ejected from the nozzles and deposited onto an image-rendering medium to form dots on the image-rendering medium; and a relative movement device which moves the droplet ejection head and the image-rendering medium relatively to each other in a relative movement direction, wherein: the droplet ejection head has a nozzle arrangement in which, out of the plurality of nozzles, a row of nozzles sharing a same liquid supply flow channel is divided into M (where M is an integer greater than one) nozzle group blocks and positions of all of the nozzles within each nozzle group block are shifted in the relative movement direction so as to provide a predetermined positional difference in the relative movement direction to the positions of the nozzles between the M nozzle group blocks, and the nozzle arrangement in which the nozzles are arrayed two-dimensionally is configured such that, between dots formed on the image-rendering medium by adjacent nozzles within a certain one nozzle row, at least one dot formed by a nozzle within another nozzle row is arranged so that the dots formed by the adjacent nozzles within the one nozzle row are arranged with an interval of N (where N is an integer greater than one) dots; the droplet ejection apparatus comprises M ejection drive devices which independently perform ejection control on the respective M nozzle group blocks; and the ejection drive devices carry out ejection drive on the nozzles within the same nozzle group block at ejection timing of a same phase, and also carry out ejection drive on the nozzles in different nozzle group blocks at different ejection timings with a phase difference corresponding to the positional difference.

According to this aspect of the present invention, out of a plurality of nozzles of a droplet ejection head, nozzles of a row of nozzles sharing a liquid supply channel for supplying liquid to the nozzles is divided into M ($M \geqq 2$) blocks, and each of the blocks is subjected to ejection control by each of M ejection drive devices corresponding to each block. All of the nozzles within each block are subjected to ejection control at substantially the same ejection timing (same phase). On the other hand, the positions of all nozzles within the block are shifted in a relative movement direction, and a predetermined positional difference is provided to the nozzles between the M blocks.

The ejection timings of the respective blocks are made different from each other, and the phase difference between the ejection timings corresponds to the positional difference of the nozzles of the blocks.

Hence, even when the ejection timings are made different between the blocks, the deposition positions are not shifted. Therefore, the ink can be deposited onto the correct positions. Moreover, the crosstalk effect and the power source capacity of the drive circuit system can be reduced. In addition, by performing N-multiple rendering ($N \geqq 2$) by arraying the nozzle two-dimensionally, the crosstalk effect can be reduced further favorably.

Preferably, a direction in which the nozzles within the row of nozzles sharing the same liquid supply flow channel are arranged has a component in the relative movement direction.

The aspect in which M division is performed in the direction of the nozzle row, that is, the relative movement direction, is preferred.

Preferably, the row of nozzles sharing the same liquid supply flow channel is divided into M along the relative movement direction, and the M nozzle group blocks are arranged in the relative movement direction.

Preferably, the positional difference in the positions of the nozzles between the nozzle group blocks is a positional difference resulting from evenly dividing, into M, a dot pitch defined by a recording resolution, and the phase difference in the ejection timings between the nozzle group blocks is a phase difference resulting from evenly dividing an ejection period into M.

In the case of the M division configuration, the positional difference in the nozzle positions between the blocks is taken as a positional difference obtained by performing even M division in a dot (pixel) pitch, and the phase difference in the ejection timings between the blocks is taken as a phase difference obtained by performing even M division in one ejection period.

Preferably, M is 2, the positional difference in the positions of the nozzles between the nozzle group blocks is ½ of the dot pitch defined by the recording resolution, and the phase difference in the ejection timings between the nozzle group blocks is ½ of the ejection period.

When configuring an elongated head by connecting the short head modules, the simplest thing is to obtain the two division structure.

Preferably, M and N are prime to each other.

A greater crosstalk reduction effect can be achieved by such configurations.

In another aspect of the present invention, an image forming apparatus includes the above-described droplet ejection apparatus, and a two-dimensional image is formed on the image-rendering medium by the droplets ejected from the droplet ejection head.

An inkjet recording device as one aspect of the image forming apparatus according to the present invention has a liquid ejection head (recording head) in which are densely disposed a plurality of droplet ejection elements (ink chamber units), each of which has a nozzle (ejection port) for ejecting ink droplets for forming dots and a pressure generating element (piezoelectric element or heater element) generating ejection pressure. The inkjet recording device also has an ejection control device which controls ejection of droplets from the liquid ejection head based on ink ejection data (dot image data) generated from an input image, wherein an image is fanned on a recording medium (image-rendering medium) by the droplets ejected from the nozzles.

For example, color conversion or halftoning processing is performed based on image data (printing data) that is input through an image input device, whereby ink ejection data corresponding to the colors of the ink is generated. The drive of the pressure generating elements corresponding to the nozzles of the liquid ejection head is controlled based on the ink ejection data, whereby the ink droplets are ejected from the nozzles.

As a configuration example of such an inkjet type recording head, it is possible to use a full-line type head that has a nozzle line in which a plurality of ejection ports (nozzles) are arrayed over the entire width of the image-rendering medium. In this case, it is possible that a plurality of relatively short ejection head modules are combined, each of the ejection head modules being shorter than the entire width of the image-rendering medium, and these ejection head modules are connected together to configure a nozzle line that is as long as the length of the entire width of the image-rendering medium.

Although the full-line head is normally disposed along a direction perpendicular to a relative feeding direction of the image-rendering medium (relative conveying direction), the head may be disposed along a diagonal direction that has a predetermined angle with respect to the direction perpendicular to the conveying direction.

The term "image-rendering medium" means a medium on which the droplets ejected from the ejection ports of the head are deposited (a printing medium, medium to which an image is formed, recorded medium, image receiving medium, ejection receiving medium, recording medium, etc.), and includes various media, such as resin sheets including continuous paper, cut sheets, stickers, and OHP sheet, films, fabrics, printed boards on which wiring patterns or the like are formed, intermediate transfer media, or other media regardless of the materials and shapes.

The conveying device which relatively moves the image-rendering medium and the head conveys the image-rendering medium with respect to the stopped (fixed) head, moves the head with respect to the stopped image-rendering medium, or moves both the head and the image-rendering medium. Note that when forming a color image using an inkjet head, heads may be disposed in relation to the colors of a plurality of inks (recording liquids), or a plurality of colors of inks may be ejected from one recording head.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet ejection apparatus, comprising:

a droplet ejection head which has a plurality of nozzles arrayed two-dimensionally, droplets of liquid being ejected from the nozzles and deposited onto an image-rendering medium to form dots on the image-rendering medium; and a relative movement device which moves the droplet ejection head and the image-rendering medium relatively to each other in a relative movement direction, wherein:

the droplet ejection head has a nozzle arrangement in which, out of the plurality of nozzles, a row of nozzles sharing a same liquid supply flow channel is divided into M (where M is an integer greater than one) nozzle group blocks and positions of all of the nozzles within each nozzle group block are shifted in the relative movement direction so as to provide a predetermined positional difference in the relative movement direction to the positions of the nozzles between the M nozzle group blocks, and the nozzle arrangement in which the nozzles are arrayed two-dimensionally is configured such that, between dots formed on the image-rendering medium by adjacent nozzles within a certain one nozzle row, at least one dot formed by a nozzle within another nozzle row is arranged so that the dots formed by the adjacent nozzles within the one nozzle row are arranged with an interval of N (where N is an integer greater than one) dots;

the droplet ejection apparatus comprises M ejection drive devices which independently perform ejection control on the respective M nozzle group blocks; and the ejection drive devices carry out ejection drive on the nozzles within the same nozzle group block at ejection timing of a same phase, and also carry out ejection drive on the nozzles in different nozzle group blocks at different ejection timings with a phase difference corresponding to the positional difference.

2. The droplet ejection apparatus as defined in claim 1, wherein a direction in which the nozzles within the row of nozzles sharing the same liquid supply flow channel are arranged has a component in the relative movement direction.

3. The droplet ejection apparatus as defined in claim 1, wherein the row of nozzles sharing the same liquid supply flow channel is divided into M along the relative movement direction, and the M nozzle group blocks are arranged in the relative movement direction.

4. The droplet ejection apparatus as defined in claim 1, wherein the positional difference in the positions of the nozzles between the nozzle group blocks is a positional difference resulting from evenly dividing, into M, a dot pitch defined by a recording resolution, and the phase difference in the ejection timings between the nozzle group blocks is a phase difference resulting from evenly dividing an ejection period into M.

5. The droplet ejection apparatus as defined in claim 4, wherein M is 2, the positional difference in the positions of the nozzles between the nozzle group blocks is ½ of the dot pitch defined by the recording resolution, and the phase dif ference in the ejection timings between the nozzle group blocks is ½ of the ejection period.

6. The droplet ejection apparatus as defined in claim 1, wherein M and N are prime to each other.

7. An image forming apparatus, comprising the droplet ejection apparatus as defined in claim 1, wherein a two-dimensional image is formed on the image-rendering medium by the droplets ejected from the droplet ejection head.

* * * * *